US006227024B1

(12) United States Patent
Koestermeier

(10) Patent No.: US 6,227,024 B1
(45) Date of Patent: May 8, 2001

(54) FLOW FORMING METHOD AND DEVICE

(75) Inventor: Karl-Heinz Koestermeier, Rietberg (DE)

(73) Assignee: Leico GmbH & Co Werkzeugmaschinenbau, Ahlen (DE)

( * ) Notice: Subject to any disclaimer, the term of this patent is extended or adjusted under 35 U.S.C. 154(b) by 0 days.

(21) Appl. No.: 09/306,779

(22) Filed: May 7, 1999

(30) Foreign Application Priority Data

May 7, 1998 (DE) ..... 198 20 470
Jul. 9, 1998 (DE) ..... 198 30 816

(51) Int. Cl.[7] ..... B21D 22/16
(52) U.S. Cl. ..... 72/85; 72/75; 72/97
(58) Field of Search ..... 72/75, 84, 85, 72/97, 98, 77, 78, 115, 117, 118, 119, 121, 91

(56) References Cited

U.S. PATENT DOCUMENTS 1,596,751 * 8/1926 Millspaugh ..... 72/78
1,638,422 * 8/1927 Walker ..... 72/75
2,070,504 * 2/1937 Bannerman ..... 72/119
2,124,961 * 7/1938 Brinkman ..... 72/75
3,452,567 * 7/1969 Marcovitch ..... 72/78
3,727,443 * 4/1973 Quinlan ..... 72/75
3,777,345 * 12/1973 Brown ..... 72/102
4,033,163 * 7/1977 Duffey et al. ..... 72/121
4,320,644 * 3/1982 Fischer ..... 72/96
4,693,105 * 9/1987 Lee, Jr. ..... 72/84
5,031,296 * 7/1991 Magnoni ..... 72/85

FOREIGN PATENT DOCUMENTS 42 18 092 C1 6/1993 (DE) .
196 36 567 A1 7/1997 (DE) .
43 13 648 C2 10/1997 (DE) .
197 13 440 A1 11/1997 (DE) .
1404671 * 9/1975 (GB) ..... 72/75
61-202742 * 9/1986 (JP) ..... 72/91

* cited by examiner

*Primary Examiner*—Lowell A. Larson
(74) *Attorney, Agent, or Firm*—Oblon, Spivak, McClelland, Maier & Neustadt, P.C.

(57) ABSTRACT

A flow-forming device includes a forming device having a cage in which a plurality of rolling members are rotatably arranged in ring-like manner about a rotation axis. A spinning chuck is configured to hold a blank so as to be axially displaceable relative to the forming device. A drive is provided for rotating the blank relative to said forming device. A method for flow-forming includes rotating at least one of the blank and the rolling member about a rotation axis and flow-forming the blank through contact with a plurality of rolling members which are arranged in a ring-like manner around the rotation axis and mounted in rotary manner in a cage.

30 Claims, 19 Drawing Sheets

FLOW FORMING METHOD AND DEVICE

BACKGROUND OF THE INVENTION

1. Field of the Invention

The invention relates to a flow-forming method, in which a preform or blank is fixed to a spinning chuck and is formed or worked by means of at least one rolling member, the blank rotating about a rotation axis relative to the rolling member. The invention also relates to a flow-forming device having a forming device with at least one rolling member, a spinning chuck on which is held a blank and which is axially displaceable relative to the forming device and a drive for rotating the blank relative to the forming device.

2. Discussion of the Background Art

DE 42 18 092 Cl and DE 196 36 567 A1 describe a method for the manufacture of a circular cylindrical gear part, on a part of whose axial length are formed internal teeth by flow-forming. With this method, a part can be manufactured in a very reasonable manner, which could otherwise only be manufactured at high cost by a cutting procedure. The advantage of manufacture by flow-forming is a virtually final contour-near production, accompanied by a high dimensional stability and a limited peak-to-valley height of the parts produced. Simultaneously material hardening is brought about in the region near to the surface, which has a favorable affect on the wear performance and fatigue strength. During forming, the blank is spun in the tooth profile of a tool by means of one or more spinning rollers, the teeth being completely filled. However, the high loading of the tooth profile of the tool is disadvantageous in this manufacturing procedure. When rolling in the internal teeth, as a result of the penetration of material into the tool tooth profile, bending and impact stress occurs to the teeth. The repeatedly occurring alternating loads lead to tool material fatigue. Ultimately cracks form and the tool fails after a short time. These processes are described in detail in DE 197 13 440 A1.

Tools are also known for planishing and workhardening which are based on hydrostatically mounted spherical tools. With the aid of such tools, a plasticizing of metallic surfaces is brought about by balls or rollers, so that marginal areas can be smoothed or workhardened. As a result of the different embodiments of such tools, it is possible to machine variably designable surfaces (e.g. straight or spherical plane surfaces or bores). The forming of larger material volumes and consequently the shaping of new geometries is not possible with such tools because material plasticizing is impossible due to the manufacturing method used. The transmittable forces are too small for this purpose. Each individual forming or working roll is separately mounted. This construction is unsuitable for the shaping and working of larger material volumes.

Methods are also known in which a blank is flow-formed to its external diameter using one or more rollers, the material penetrating the profile of the tool chuck. Another method proposes the axial fixing of the blank and reducing the diameter thereof accompanied by a radial infeed. As a result of the axial fixing the material flows radially as a result of the pressure of the rollers, so that it is pressed into the recesses of the tool chuck.

In all the aforementioned methods, use is made of individually mounted or seated rollers, which roll with their external-diameter on the blank. As a result of the geometrical and strength-caused dimensions of the rollers with their bearings, as a function of the circumference of the blank, only a limited number of rollers can be arranged in a minimum spacing. Due to the geometrically caused spacing between the rollers, it is impossible to completely compensate the bulging of the circumference of the blank due to the high tangential force in this area and the associated material displacement. Thus, alternating loads occur in the vicinity of tool chuck recesses.

Particularly with working teeth with small modules, this alternating loading can lead to material fatigue and therefore to a short lifespan of the tool.

SUMMARY OF THE INVENTION

Therefore the object of the invention is to provide a flow-forming method and device, in which flow-forming is possible in such a way as to protect both the workpiece and the tool.

According to the invention, this object is achieved in that in the aforementioned method, the blank is formed by a plurality of rolling members, which are arranged in a ring-like manner around the rotation axis and are in each case mounted in rotary manner in a cage. The object is also achieved by a flow-forming device having the features for performing this method.

As a result of the mounting of the numerous rolling bodies in a cage, it is ensured that the blank is supported at its circumference during its rotation by the geometrically maximum number of rollers and is simultaneously formed or worked. The forming rollers encircle the blank in planet-like manner on contacting and forming the same. The blank is an axially symmetrical workpiece, which is solid or a premachined hollow body, such as a pipe length or a cup-shaped part.

In known flow-forming procedures as a result of the separate mounting and control of the spindles due to an axial displacement of the rollers, the shaping process is always started by one roller, so that necessarily there is an undesired deflection of the tool until further axially displaced rollers engage. Therefore, due to this alternate deflection of the forming tool, a uniform loading and autocentring is scarcely possible. In the method according to the invention, the force is symmetrically and uniformly transmitted to all the rollers by means of an outer race of a bearing. Thus, all the rollers act simultaneously in the forming process and thereby independently centre and uniformly load the inner tool.

Appropriately, the blank is moved in a relative axial movement through the ring-like rolling member arrangement. In the case of a hollow blank, the rolling members press it onto the spinning chuck. There can also only be a diameter reduction with a solid blank. The rolling members can be located in a common radial plane. When using a cup-shaped workpiece having a cylindrical side wall and a bottom wall, for a precise forming of the cylindrical wall moving the rolling member from the open end towards the bottom of the workpiece.

If, in preferred manner, the blank is formed by conical rolling rolls which roll in a conical outer race in an arrangement inclined to the blank rotation axis, it is possible to obtain an improved centring on introducing the blank into the rolling member arrangement and also a favorable material flow. As a result of an axial displacement and positioning of the rolling bodies with the cage, a positioning and setting of the rolling bodies is possible.

If the blank is formed by rolling members axially displaced with respect to one another in a single shaping process, a greater diameter range can be covered if the following rolling members in each case roll on a smaller internal diameter. Such an arrangement leads to an improved forming force distribution and action on the blank.

In an appropriate method variant, the blank is formed by rolling members which are arranged in a forming device in two parallel planes perpendicular to the rotation axis. This leads to a simplified construction of a cage seating the rolling members.

To be able to perform different forming or working operations on blanks, rolling members with different shapes and sizes can be used in a forming device, such as in a common cage or in different, successively arranged cages. For example, this makes it possible to form in a single setting bodies having different internal profiles in different diameter ranges.

It is also possible by using spherical rolling members to carry out a first forming of a blank, e.g. a circular blank in a first machining plane or area and by means of conical rolling members, in a following, second machining plane or area, to carry out a second forming of the blank. Thus, extensive blank machining can take place in a single setting.

In one embodiment, the radial positioning of the rolling members is adjusted against a spring tension. This makes it possible to bring about an autocentring and self-adjustment of the rolling members in a simple way.

If the relative rotation direction between the blank or spinning tool and the rolling members is changed in alternating manner, the direction of the force introduction on the blank and the spinning tool is frequently changed, which leads to a forming operation better protecting the material and the tool.

If, following the shaping of the internal teeth, a calibrating or sizing process is carried out, said step can be performed with the workplace fixed. The sizing process can be carried out with the rolling member arrangement in the forming device set to smaller internal diameters. Alternatively, the sizing process can be performed with a second rolling member arrangement with a smaller internal diameter in a second forming device.

The production of the relative movement between the rolling members and the blank can be carried out, with the blank stationary, by rotating an external race in which the rolling members roll. The relative movement can also be brought about by rotating the preform with the outer race stationary or by rotating the outer race and the preform.

The method according to the invention can be appropriately supplemented in that over the workpiece obtained, following the forming of the blank, is drawn a draw ring with an internal tooth profile for the purpose of producing external teeth.

According to another preferred embodiment of the invention, the blank is constituted by an axially symmetrical sheet metal workplace which is pressed on the spinning chuck by means of the rolling members arranged in ring-like manner. The sheet metal workpiece can be a circular blank or a cup-shaped part. This makes it possible to shape a sheet metal body with an internal contour corresponding to the spinning chuck.

Preferably the blank is fixed to a cylindrical spinning chuck, which is provided on its outer circumference with a profiling or contouring, particularly a tooth system, and during forming, the rolling members are arranged in ring-like manner around the spinning chuck, the blank being pressed by the rolling members against the outer circumference and an internal profile is formed. This makes it possible to produce internally contoured parts, e.g. with an internal tooth system or a spline.

According to an alternative variant of the invention, the blank has a central opening and is centrally fixed to an annular spinning chuck, whose ring inside is provided with a profiling, particularly internal teeth, and that for forming purposes, a forming mandrel is axially infed into the central opening of the blank where the rolling members are arranged in ring-like manner. The blank is pressed by the rolling members against the ring inside of the spinning chuck and an external profile is formed. In this way, externally toothed internal gears, for example, can be efficiently manufactured.

According to the invention the method is performed in a particularly simple manner in that during forming, the rolling members in the cage are displaced at least radially. The rolling members are radially displaceably mounted in the cage and can be pressed radially inwards or outwards by means of a wedge valve mechanism, for example. The radial displacement of the rolling members also makes it possible to form a corresponding profile in the blank when use is made of profiled rolling members. The profile on the rolling members can be circumferentially directed grooves and projections or a tooth system.

Based on a flow-forming device according to the invention, from the apparatus standpoint, the object is achieved in that the forming device has a cage in which a plurality of rolling members is arranged in ring-like manner about a rotation axis and each of the rolling members is mounted in rotary manner in the cage. Such a flow-forming device is used for performing the above-described method. There are at least two rolling members, but independently of the workpiece size, a maximum number thereof is preferred.

According to the invention, particularly good forming is brought about in that the rolling members are constructed cylindrically or conically as forming rolls and are mounted rotatably in each case about a rolling member axis and that the rolling member axes are inclined to the rotation axis by, in particular, an angle between 10 and 60°. As a result of the axial extension of the rolling members and their conical arrangement with respect to the rotation axis, a novel forming or working technology is obtained, which combines characteristics of flow-forming with those of ironing. This combination permits a high degree of forming at a relatively high forming speed.

For the application of high forming forces, according to the invention, it is advantageous for the forming device to have a ball race on which the rolling members engage on a rolling area and roll during forming.

An increase in the design possibilities with the inventive device is brought about in that the rolling area of the ball race is conical, that the rolling manners in the cage are displaceably radially mounted and that for the radial displacement of the rolling members, the ball race is axially adjustable.

According to the invention the rolling members can be provided with an external profile, which can be a tooth system or circumferentially directed grooves and projections which form a corresponding profile in the blank.

For the production of hollow bodies, the spinning chuck is cylindrical and the forming device has an annular construction, the rolling members projecting from its inside. On the outer circumference of the spinning chuck can be provided a desired profile which is imaged by pressing the blank on to the spinning chuck.

The invention makes it possible to produce hollow bodies with an external contour in that the spinning chuck is annular and the forming device is constructed as a cylindrical forming mandrel, from whose outside the rolling members project. The forming mandrel is moved axially relative to the spinning chuck and inserted in a central opening of the workpiece. The central opening of the workpiece is expanded and the material is shaped against the corresponding internal contour of the annular spinning chuck.

The rolling members could fundamentally be mounted by means of pins or bores, which are located on or in a rolling member of the forming roll. However, according to the invention, a particularly robust mounting or seating is obtained in that the rolling members are inserted in pocket-like recesses in the cage for rotary mounting purposes. This permits a particularly close juxtaposed arrangement of the individual rolling members. It is also possible to use as rolling members, simple, solid elements, e.g. rolls or rollers from conventional antifriction bearings. The mounting of the rolling members comprises an annular cage body with radial grooves for tangential mounting and a conical ball race, on which the rolling members roll for radial mounting. A clamp collar on the cage body maintains the rolling members in their axial position.

BRIEF DESCRIPTION OF THE DRAWINGS

The invention is described in greater detail hereinafter relative to embodiments and the attached drawings, wherein.

DETAILED DESCRIPTION OF THE DRAWINGS

Figure 1:
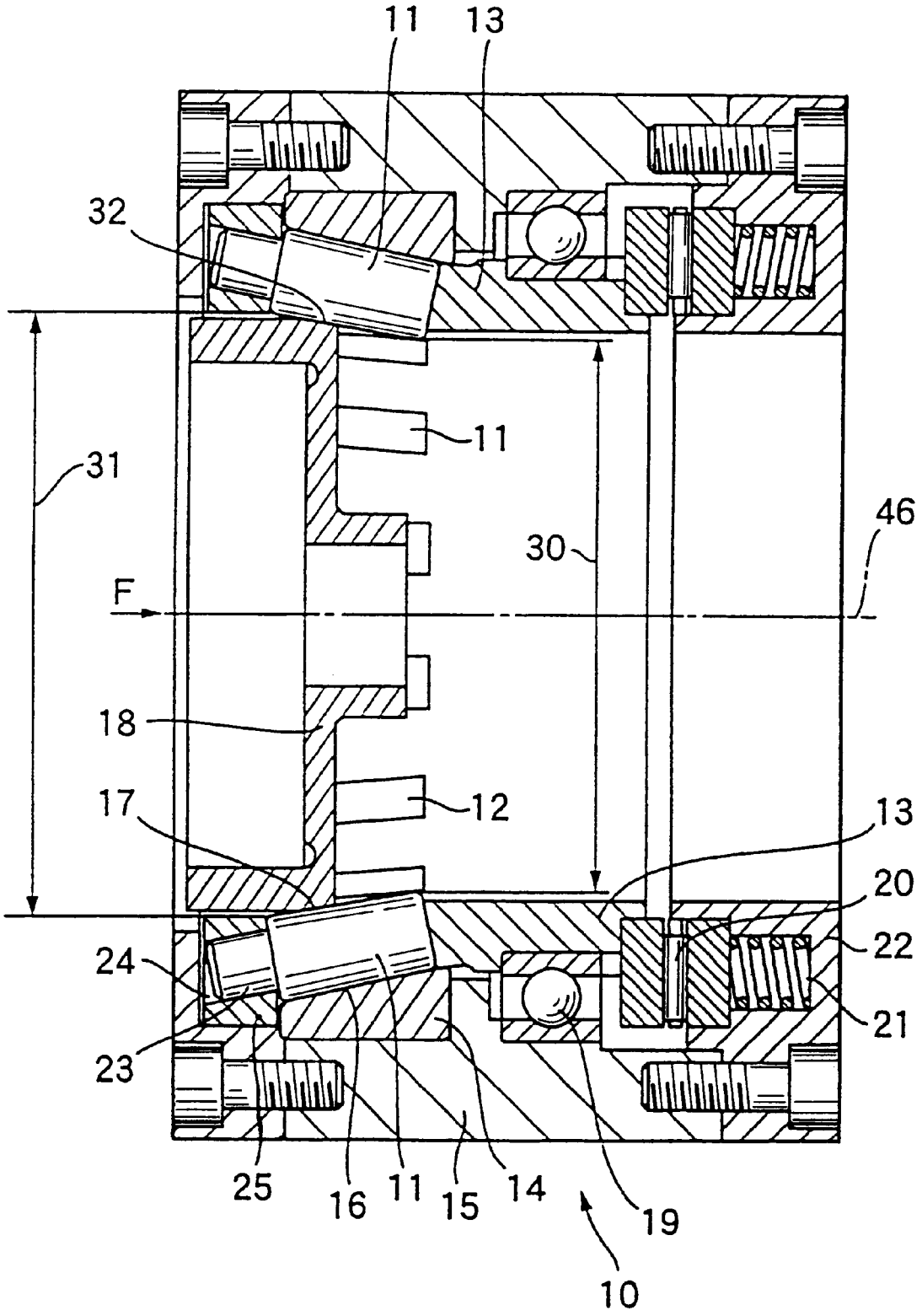
FIG. 1 is a sectional view of a device for performing the inventive method with a blank located therein.
Figure 6:
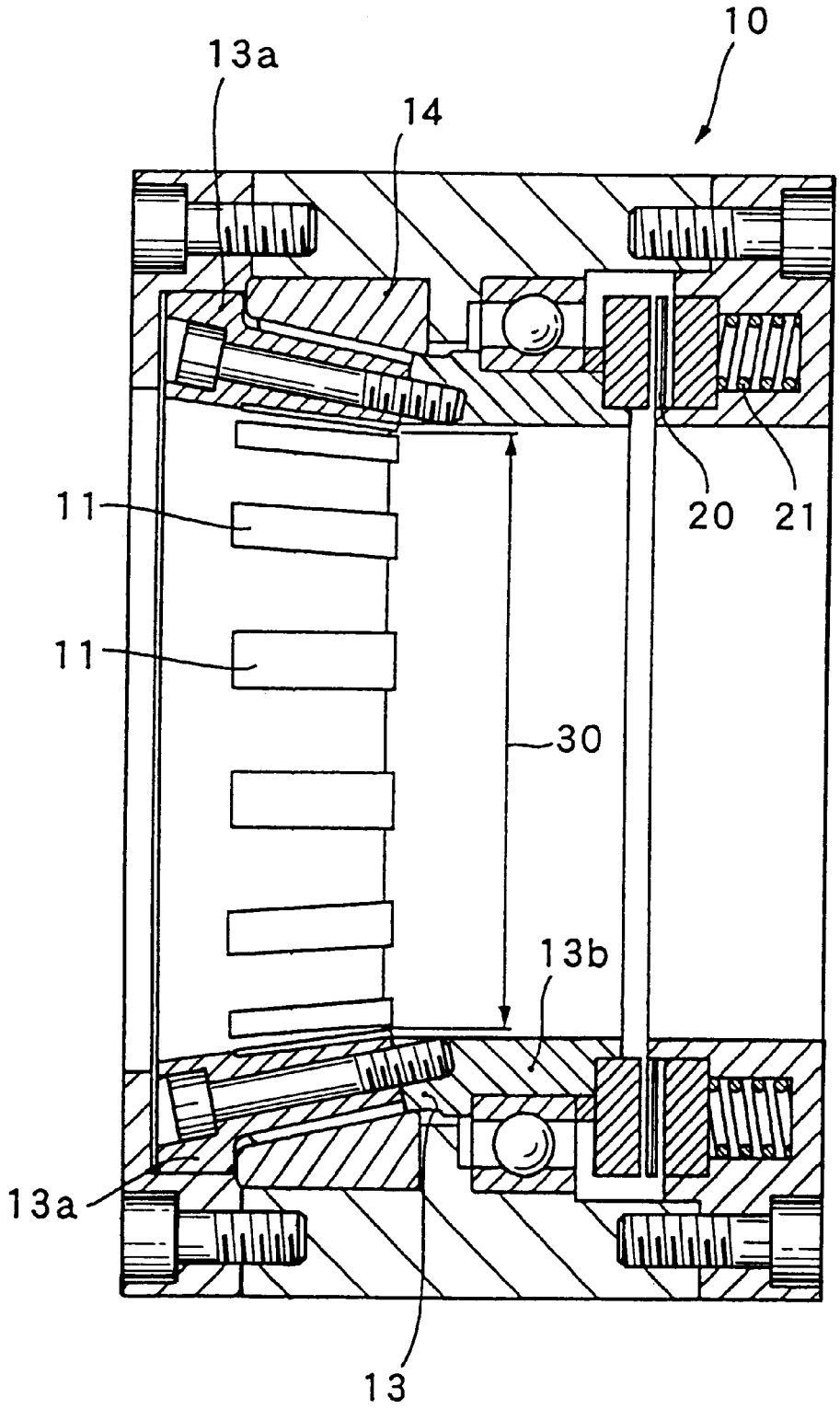
FIG. 6 is a sectional view a device for performing the method according to the invention.
Figure 7:
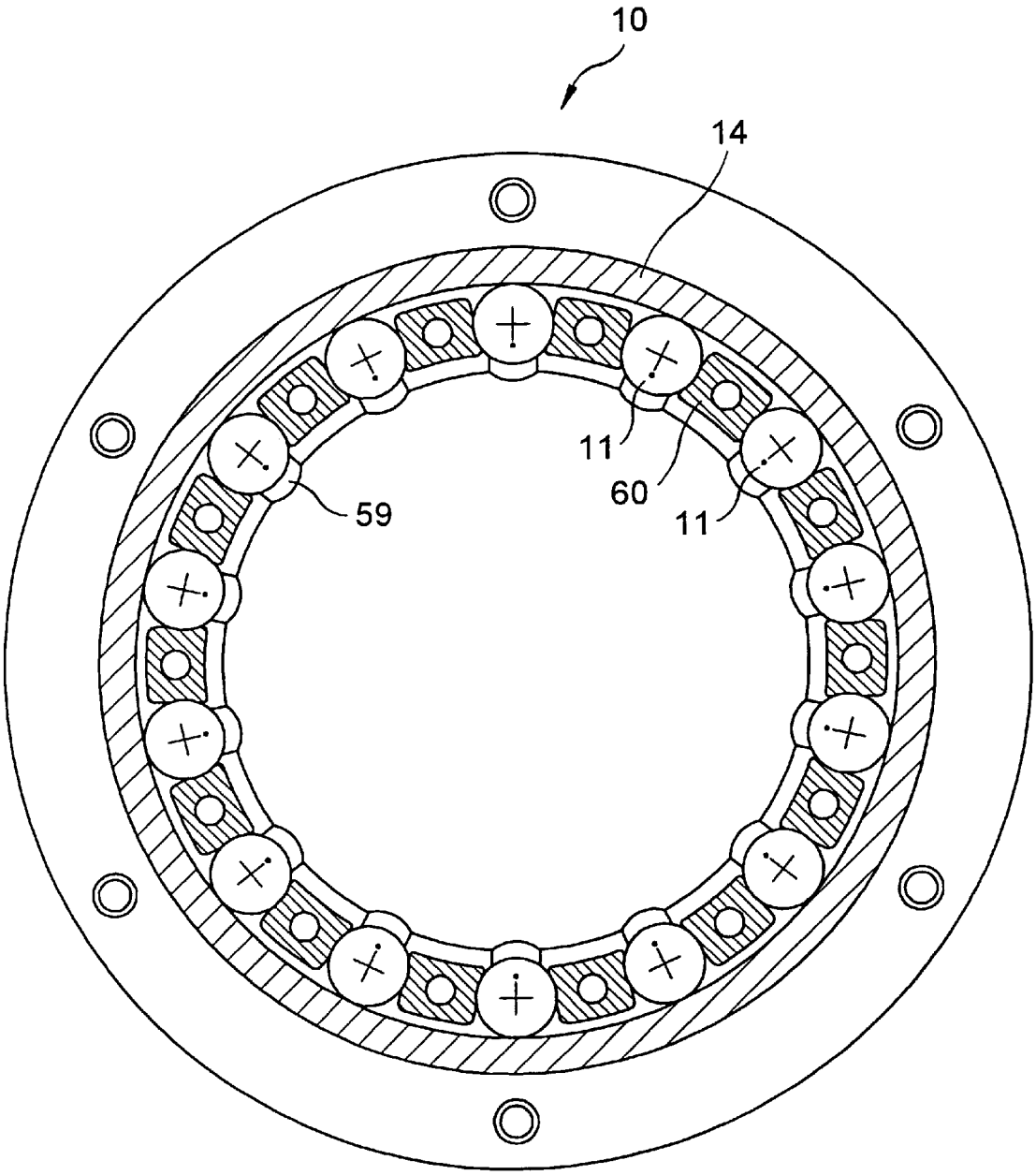
FIG. 7 is a sectional view at right angles to the rotation axis, the device of FIG. 6.

A device or tool 10 for performing the method according to the invention as shown in FIGS. 1, 6 and 7, has a plurality of rollers as rolling members 11 (14 rollers in the embodiment shown), which are received in recesses 12 formed in an annular support member or cage 13 of the device 10 and guided axially and radially. A fixed, outer ball race or outer race 14 is inserted in a casing 15 of the device 10 and forms an outer, hardened track 16 for the rollers, whilst an inner track 17 is formed by a blank 18 to be formed or worked. The annular cage 13 is radially and rotatably mounted in the casing 15 of the device IO by means an of a ball bearing 19. An axial bearing 20, e.g. a needle bearing, axially supports the cage 13 by means of a spring mechanism, e.g. in the form of several helical springs 21, on a casing and part 22 connected to the casing 15 e.g. by screwing.

The cage 13 is constructed in such a way that the rolling members 11 are held in position when no inner bearing surface is provided, i.e. when the blank is has not yet been received or is no longer received in the tool or device 10.

This holding function can e.g. be brought about in that holding elements such as frontal pins 23 are shaped on or fitted to the rollers and are received in a rotary manner in bores 24 in a holding ring 25 connected to the cage 13. Profiles or bores can be applied to the rolling members 11 as holding elements. It is appropriate to keep the external diameter of the rollers to an inside internal diameter thereof, in that the outer jacket of the rolling member 11 is supported in a recess of a ring, so that roller segments 59 project in a defined manner out of the internal diameter of the bore of the ring (cf. FIG. 7).

The geometries of the bearing surfaces are such that they satisfy both the requirement profile of the forming and the geometrical requirement of superimposed rolling.

If, in accordance with FIG. 1, rolling members 11 are used within a conical, outer ball race 14, within the enveloping circle of rolling members 1I1 defined by the inner track 17, there is an imaginary envelope body shape with a small opening diameter 30 and a large opening diameter 31. If the blank 18 is provided with a bevel 32 on the immersion side, i.e. on the side of first contact with the rolling members, whose angle corresponds to the angle of the conical envelope body shape or the inner track 17, on contact of said bevel 32 with the conical rolling members 11, there is automatically an improved centering of said rolling members 11 with respect to the blank 18.

The rolling members 11 can be axially adjusted relative to the outer ball race 14. If the blank 18 axially applies a pressing force to the device 10, relative to the outer ball race 14, the small opening diameter 30 of the enveloping circle is as is set by the adjustment. As a result of this function, the enveloping circle of the rollers 11 can be opened to a larger diameter so that on withdrawing the blank 18, no additional flow-forming operation has to be performed on the ironed workpiece. For this setting, the support body holding the rollers or cage 13, together with the holding ring 25, is axially provided with a clearance in such a way that the springs 21 behind the axial bearing 20 press the cage 13 out of the conical, outer race 14. As soon as the rollers are in contact with the blank 18, they spring back on the stop member provided and are again set to the adjusted opening diameter.

The nature and number of the rollers can be adapted to the forming operation. It has proved appropriate to use rolling members from conventional tapered roller bearings, which are inexpensively manufactured in a mass-produced manner. The outer race 14 can be completely taken over by corresponding roller bearings. The number of rolling members 11, corresponding to the necessary forming forces per roller, can be reduced as a function of the roller division compared with the original roller bearing.

Through a suitable choice of individual forming parameters and their mutual matching, the forming or shaping conditions of the workpiece can be adapted relative to an externally toothed tool chuck. Such parameters include the feed of the forming device, the speed of the workplace or forming device, and the number and shape of the individual forming members.

If a larger diameter range is to be covered with a constant conicity of the rollers, every other roller can be positioned in an axially displaced manner in a corresponding device. Thus, the width of the coverage is reduced from roller to roller and the diameter range is widened from the maximum to the minimum diameter of a revolution.

It is appropriate for larger diameter ranges to produce forming devices, which can then be successively exchanged within a forming Centre, also for shaping steps.

The combination between the spinning rollers and the presently proposed tool and a drawing device with a draw ring is appropriate for internal and external teeth. The draw ring can be exchanged as a tool in the forming centre, so that after flow-forming with a hollow body tool, a draw ring with a corresponding internal profile can be drawn over the previously rolled workpiece. On drawing the external teeth, it is appropriate in the axial direction to limit the workpiece by a stop member, so that the material substantially flows in the tooth profile of the draw ring and no workpiece elongation occurs. The resulting tooth profiles can then be completely profiled with a shaping wheel by means of a synchro-unit in a flow-forming machine in accordance with DE 196 01 020 A1, followed by sizing and work-hardening in the tooth surfaces.

Figure 2:
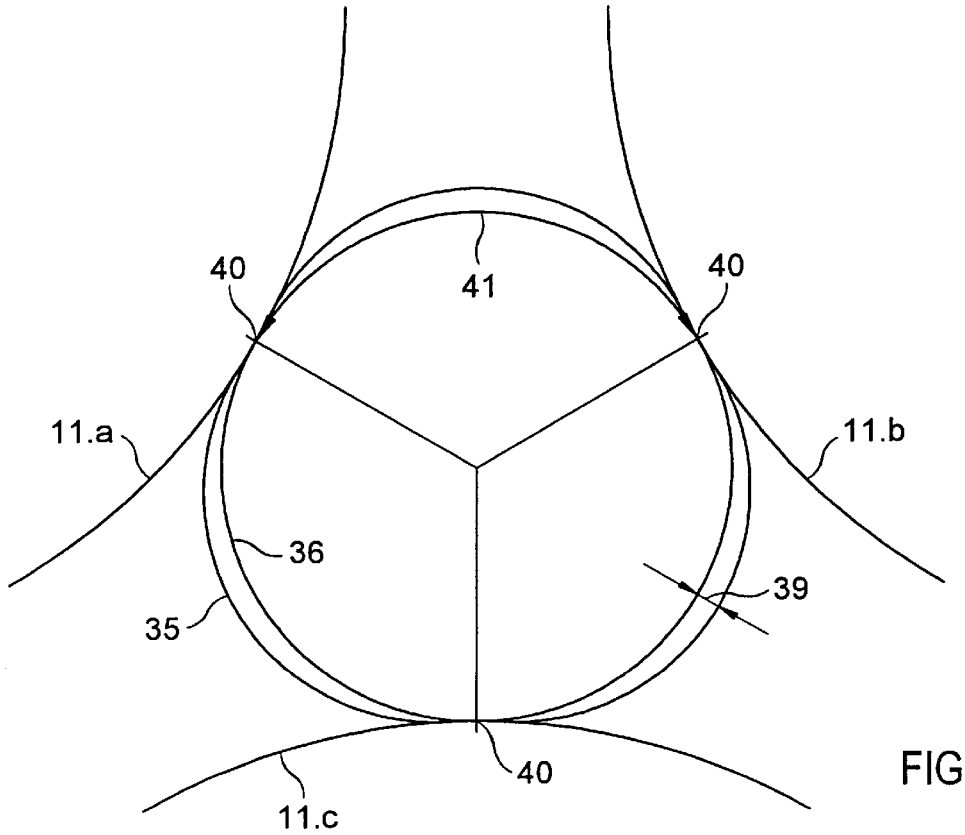
FIG. 2 diagrammatically illustrates a cylindrical workpiece, which is machined in the manner known from the prior art with three spinning rollers and the resulting deformation of the workplace.
Figure 3:
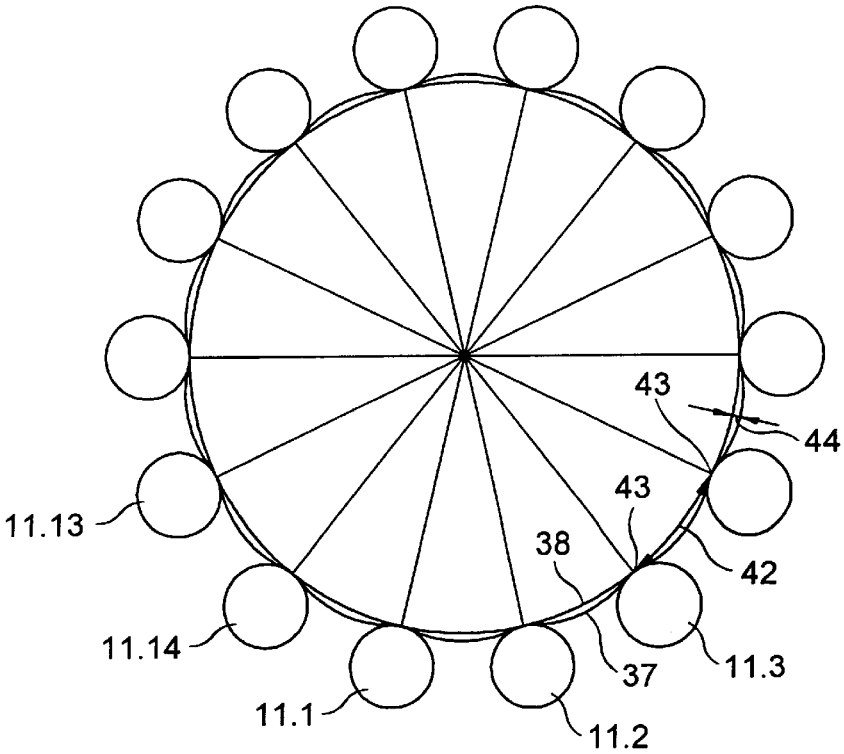
FIG. 3 diagrammatically illustrates a cylindrical workpiece, which is machined with a plurality of spinning rollers according to the inventive method and the resulting deformations of the workpiece.

FIGS. 2 and 3 show a comparison of the inventive method and a conventional flow-forming process with a maximum of three rollers. FIG. 2, as a schematic diagram, showing three rolling members 11*a,* 11*b,* and 11*c* rolling a blank or workplace 35 on a tool 36 in a conventional manner. For comparison purposes, FIG. 3 shows the use of the inventive method for this purpose. A workpiece 37 is formed on a cylindrical tool 38 with e.g. 14 rolling members 11.1 to 11.14.

The diagrammatic representations of FIGS. 2 and 3 make clear the advantages of the method according to the invention, each of which are discussed in detail below, numbered 1 and 2.

1.) Minimizing the bulging of the blank through the use of several forming rolls.

The force application of three rolling members 11*a,* 11*b* and 11*c* in a conventional manner according to FIG. 2 to the circumference of the blank 35 leads to a clear bulging 39 thereof between the force application points 40 as a result of the tangential stresses introduced. Due to the relatively large mutual spacing of the rollers, there is a very considerable unsupported circumference 41 in which the blank 35 can bulge. The tangential stress necessary for bulging is consequently relatively low and the divergence 39 from the ideal circular shape is relatively large. The consequence is a high frequency alternating loading of the profile in the tool chuck, which leads to a very considerable profile break risk.

As a result of the separate mounting and the size of the forming rolls or rollers, there is no autocentering of the tooth-forming tool. Instead, as one roller must always react to the movement of the other, a constant bending out of the tool occurs.

FIG. 3 shows how, in accordance with the method of the invention, through the use of far more and much smaller rolling members 11.1 to 11.14, which run on a common outer race (not shown), the bending out 44 is decreased with an increasing number of rolling members 11 and moves towards zero, because the unsupported circumference 42 between two force application points 43 is significantly reduced.

It is also clear that, for the same tangential stresses, due to the shorter distance between the rollers, the bending out cannot reach the values occurring with only three rollers. In fact, the bulging or bending out 44 is negligibly small compared with that occurring when forming using only three rolling members 11*a* to 11*c*.

2.) More uniform force distribution.

There is a relatively non-uniform force introduction when forming with only three rollers. The reason is the asymmetrical force application of the differently mounted forming tools, so that the teeth are not uniformly supported. When material flows into the tooth spaces of the toothed tool, there is initially a one-sided supporting of the tool teeth, so that the tooth is loaded on one side and bends out.

When using the previously described forming tool with e.g. 14 rollers, which run in a common outer race, the material flow into the tooth spaces is more uniform, so that the alternate loading due to bulging is reduced to a minimum. The workpiece supports both the front and back of the teeth and consequently significantly reduces one-sided loading.

Figure 4:
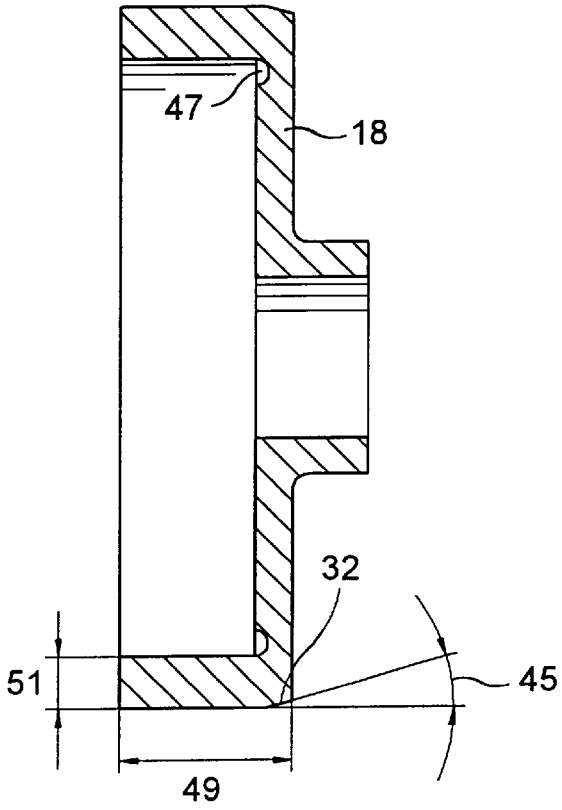
FIG. 4 is a sectional view a blank, on which is to be produced an internal tooth system according to the method of the invention.

FIG. 4 shows a blank 18 on which internal teeth are to be produced. The blank 18 is cup shaped and can e.g. be produced by a flow-forming process. However, the presently described method can also form or work other blades, e.g. those produced by cutting. The cylindrical body of the blank 18 acquires, on the entry side of the forming devices, a chamfer 32 whose angle 45 is identical to the angle of the inner roller track 17 with respect to the center or rotation axis 46 of the forming device 10 (cf. FIG. 1). As a result of the conicity of the arrangement of the rolling members 11 in the forming device 10, a centering of the blank 18 and a uniform material filling of the teeth is obtained and a tangential compressive stress and an axial tensile stress is produced in the workplace surface. A recess 46 on the internal radius prevents the formation of cracks by reducing the notch effect and the unnecessary displacement of excess material.

Figure 5:
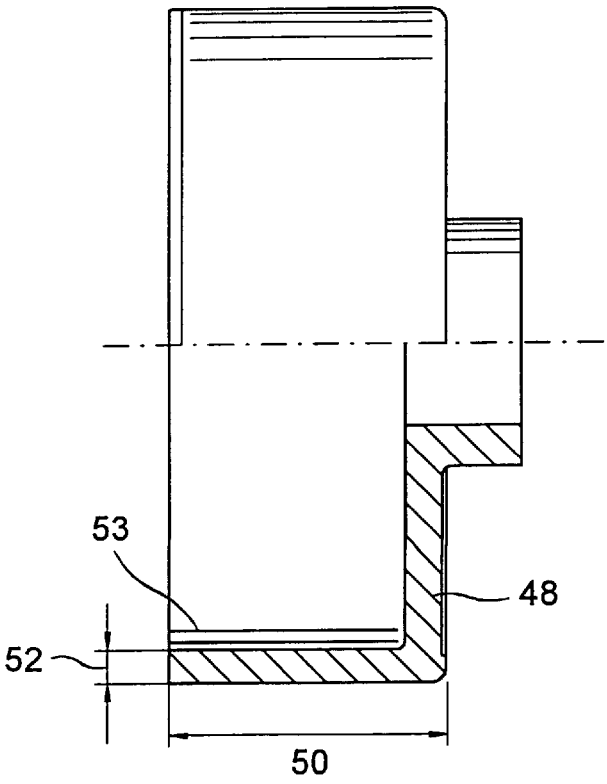
FIG. 5 is a sectional view a workpiece with an internal tooth system produced by machining the blank shown in FIG. 4.

FIG. 5 shows a workpiece 48 following the shaping of the blank 18. As a result of the forming process, it is e.g.

possible to produce a sloping internal tooth system 53. As a result of the forming process, the workpiece 48 is axially lengthened (cf. the axial lengths in FIGS. 4 and 5 given the reference numerals 49 and 50) and the wall thickness is reduced (cf the axial wall thicknesses in FIGS. 4 and 5 given the references 51 and 52).

FIGS. 6 and 7 show the device 10 preferably used for the forming operation and which only differs slightly from that according to FIG. 1. This device is constructed on the basis of a tapered roller bearing, which is modified in such a way that initially, its inner race is removed. The now exposed rolling members 11 of the tapered roller bearing are secured by a special cage 13 instead of by a conventional tapered roller bearing cage and which has an annular cage body 13*a* and a clamp collar 13*b*. The rolling members 11 are placed in radial grooves which taper towards the workpiece, in the cage body 13*a*. During forming, the rolling members 1I are held radially by a ball race 14 and axially by the clamp collar 13*b*. As a result, the position of the rollers is fixed and their mutual displacement prevented. As a modification of the representation, the rollers can have frontal pins (cf. FIG. 1), profiles or bores.

During forming, the clamp collar 13*b* is axially supported by springs 21 and needle bearings 20. The springs 21 press the clamp collar 13*b* with the rolling members 11 out of the outer, conical ball race 14 and set a relatively large internal diameter 30, as is required for moving out the parts.

If, during forming, a blank 18 presses axially on the rolling members 11 in the cage 13, the springs 21 are compressed and the internal diameter 30 is reduced to the effective internal diameter previously set by an axial adjustment. The clamp collar 13*b* is radially supported by the ball bearing 19. During forming, the rollers move in or on the outer race 14, the rolling members 11 revolving in planet-like manner and rotate the cage body 13*a* with the clamp collar 13*b* screwed to it. Use is preferably made of profiled rollers for forming internal teeth.

On modifying the cage 13, it is also possible to use balls, combined with rollers, as rolling members. The inserted balls, which project at the front out of the entry side of the support member, are used for forming a circular blank so as to give a cylindrical blank, the following rollers reducing the external diameter of the blank in the same setting and roll on a tool with teeth.

Figure 11:
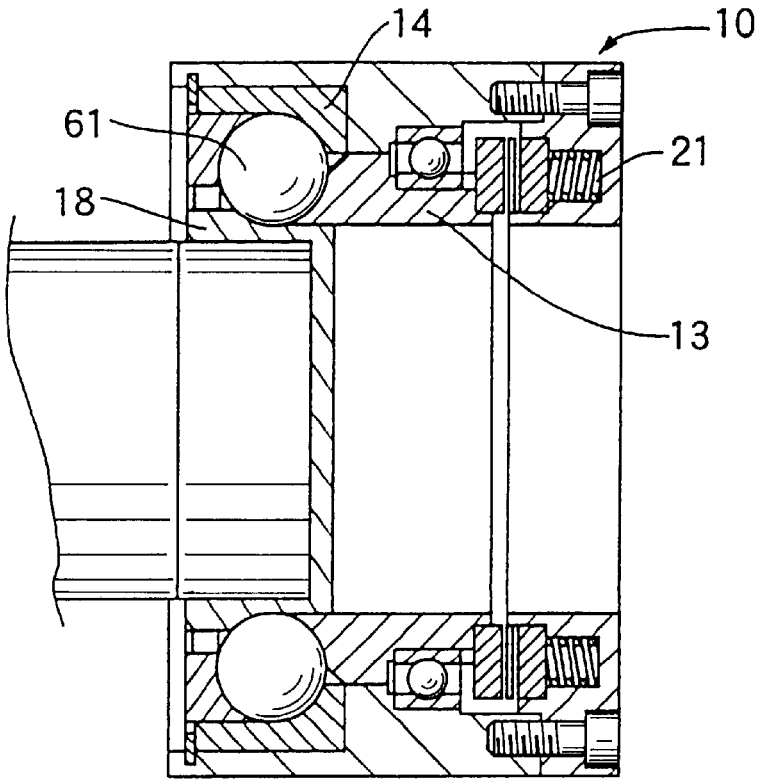
FIG. 11 is a sectional view another embodiment of a device for performing the method according to the invention.
Figure 12:
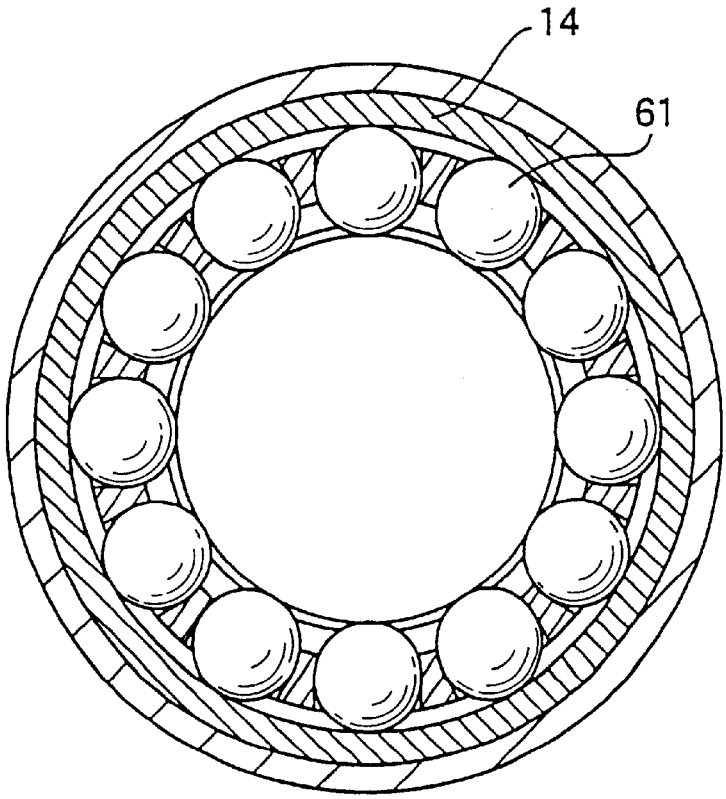
FIG. 12 is a sectional view perpendicular to the rotation axis, the device of FIG. 11.

FIGS. 11 and 12 show a device 10 with balls 61 which are placed in the form of an inclined ball bearing in the cage 13 and are radially and axially supported on the outer race 14 adapted to the balls 61.

The number of rollers or balls, generally the rolling members 110, is a function of the tooth geometries and the forces required during shaping. 14 rollers are used in the present example. This on the one hand largely prevents the bulging of the workpiece during manufacture and on the other ensures an adequate centering of the forming tool 10.

During forming, the rollers rotate in the support member or cage 13 about the axis thereof and revolve in planet-like manner round the blank 18. It is alternatively possible to rotate, i.e. drive the forming tool 10, via the outer race 14 or casing 15, with the rolling members 11 revolving in planet-like manner in order to stop the tool chuck with the blank 18.

Figure 8:
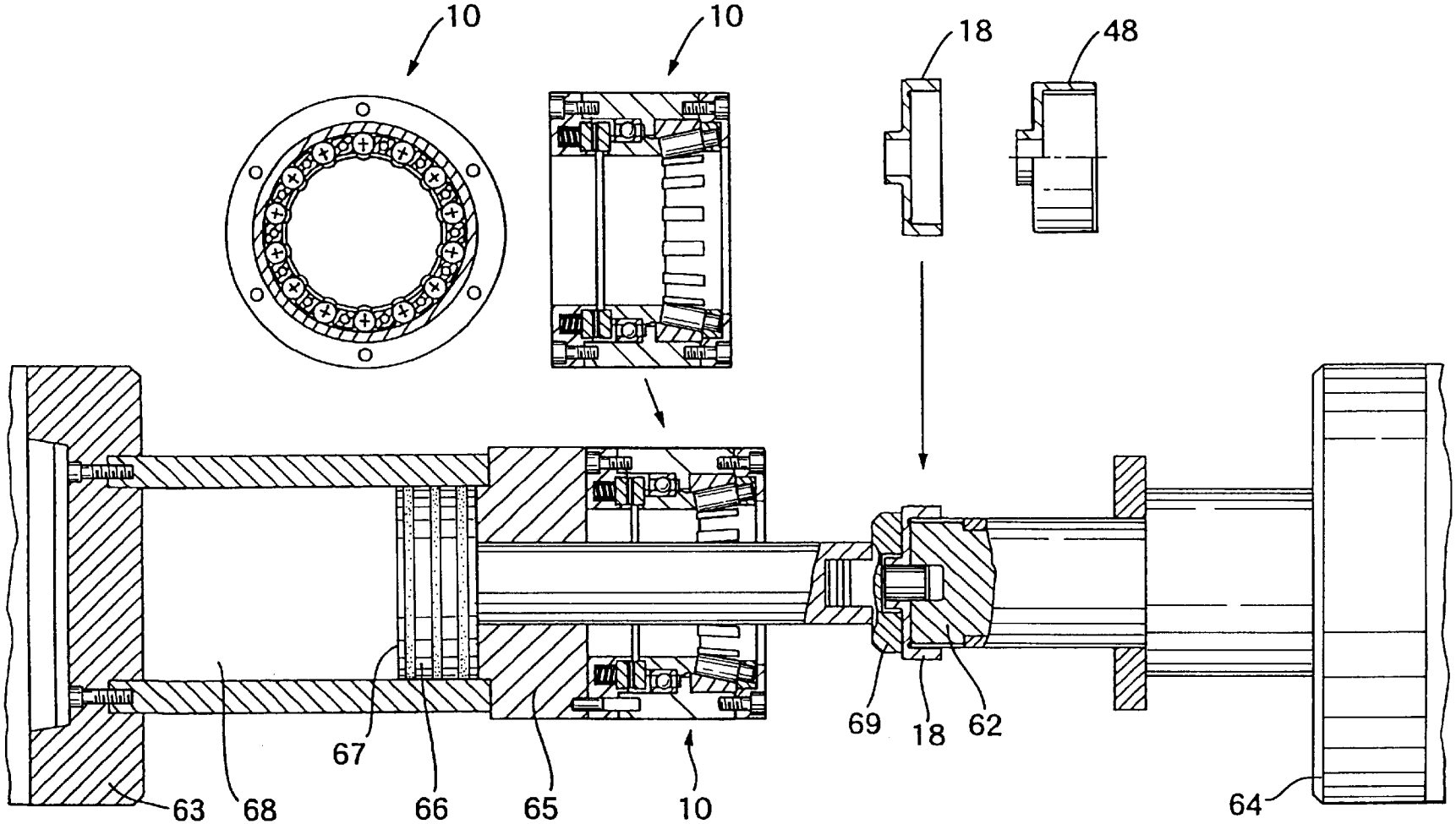
FIG. 8 is a part sectional view the overall construction of a device for performing the method according to the invention.
Figure 9A:
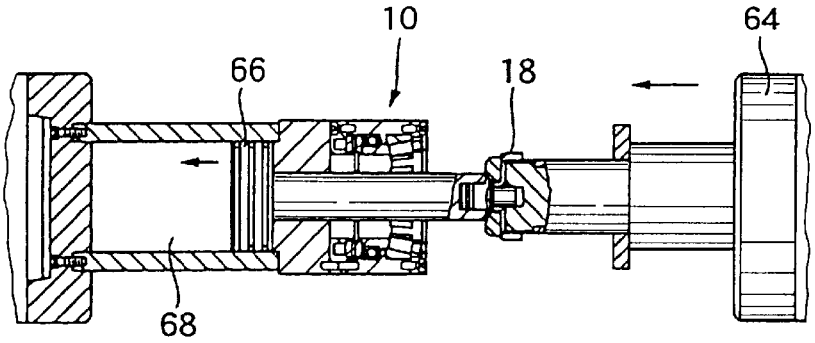
FIG. 9 is the method sequence in four views (9.1 to 9.4)
Figure 9B:
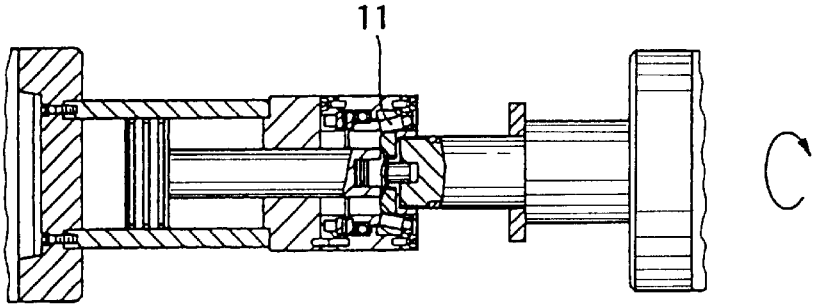
Figure 9C:
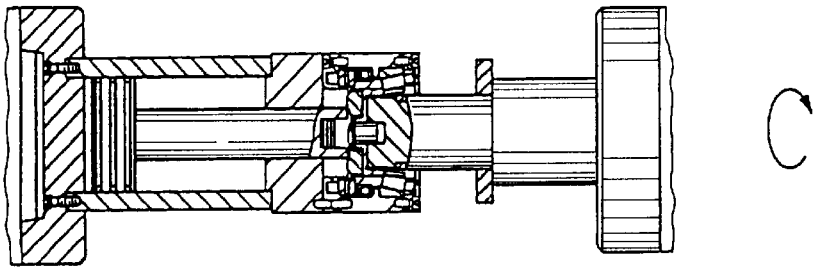
Figure 9D:
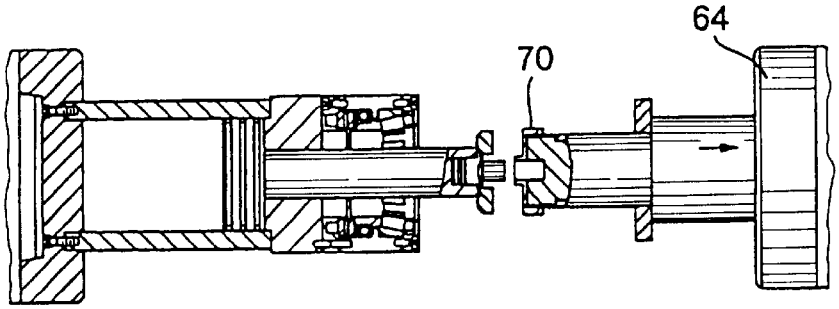

FIG. 8 shows the construction of the device for rolling in a tooth system. A blank 18 is e.g. fixed in a flow-forming machine and engaged over a toothed spinning chuck 62. The internal diameter of the blank 18 corresponds to the external diameter of the spinning chuck 62. The bottom of the blank 18 is fixed between the two drive spindles 63 and 64 of the flow-forming machine. In the represented case, a forming device is fixed to a cylinder 65 of one drive spindle 63 (tailstock) of the machine. A piston 66 is supported on one side 67 against an oil filling in a cylinder chamber 68 and frictionally clamps the blank 18 on the other, facing side 69.

On rolling in the tooth system, rotation takes place of either only the workpiece or the blank 18 with a predetermined speed and the forming device is stationary, or the device 10 rotates and the workpiece 18 is stationary. In each case this leads to an autorotation and a planet-like revolving of the rolling members 11. In accordance with the number of teeth to be produced or the external diameter of the workpiece, the speed of the rollers 11 can be adapted by varying the speed of the workpiece or the forming device.

Forming takes place in the manner shown in FIG. 9, where FIGS. 9.1 to 9.4 represent the individual machining steps. As shown in the figures, blank 18 is moved by the forward movement of a drive spindle (main spindle) 64 in the direction of the forming device 10 (FIG. 9.1). The piston 66 is forced into the cylinder 68. For the maximum internal diameter of the forming device 10 the rolling members 11 initially engage with the outer radius of the blank 18. The blank 18 is then moved further towards the forming device 10 and is moved into the latter. As has already been described, the springs 21 in the forming device 10 are compressed and consequently set the effective internal diameter. The rotating rolling members 11 roll the blank 18 on the externally toothed spinning chuck 62 (FIGS. 9.2 and 9.3). As a result of the conical shape, the effective internal diameter of the forming device 10 becomes ever smaller and the material is rolled ever further into the tooth system. An internal tooth system is formed, which in negative corresponds to the tooth system of the spinning chuck 62. The blank 18 is lengthened and the wall thickness reduced. During the rolling in the tooth system, the rotation direction of the workpiece can be changed in alternating manner. The time of a motion reversal is dependent on the particular tooth geometry and the selected feed. With the motion reversal, the direction of the tangential rotation of the workpiece 18 on the spinning chuck 62, as occurs in conventional flow-forming processes, is modified. Following shaping, the spindle 64 returns and the now internally toothed workpiece 70 is e.g. removed with a stripper.

Following the forming of the internal toothed system, its sizing or calibration may be necessary and this can be carried out in different ways:

1. By a conventional flow-forming process with three spinning rollers, the material is rolled in the tooth system and consequently dimensionally sized.
2. By a second forming device of the described type having a smaller internal diameter, the material is rolled in the tooth system of the tool chuck so that the tooth system is shaped to the final dimensions. This makes it possible to produce in a number of stages tooth systems using step tools.
3. By readjustment of the actual forming device it is possible to vary the internal diameter effective during forming. By means of this setting, the internal diameter is set in such a way that only a second forming stage with the same forming device is required as is then used for sizing the tooth system.

The structure of the forming device can differ in three variants, each of which is discussed in detail below, numbered 1 to 3.

1. The forming device 10 is fixed to a drive spindle 63 of a flow-forming machine (FIG. 8). The blank 18 is fixed between the two drive spindles 63, 64 and is subsequently moved by the forming device 10.

Figure 10:
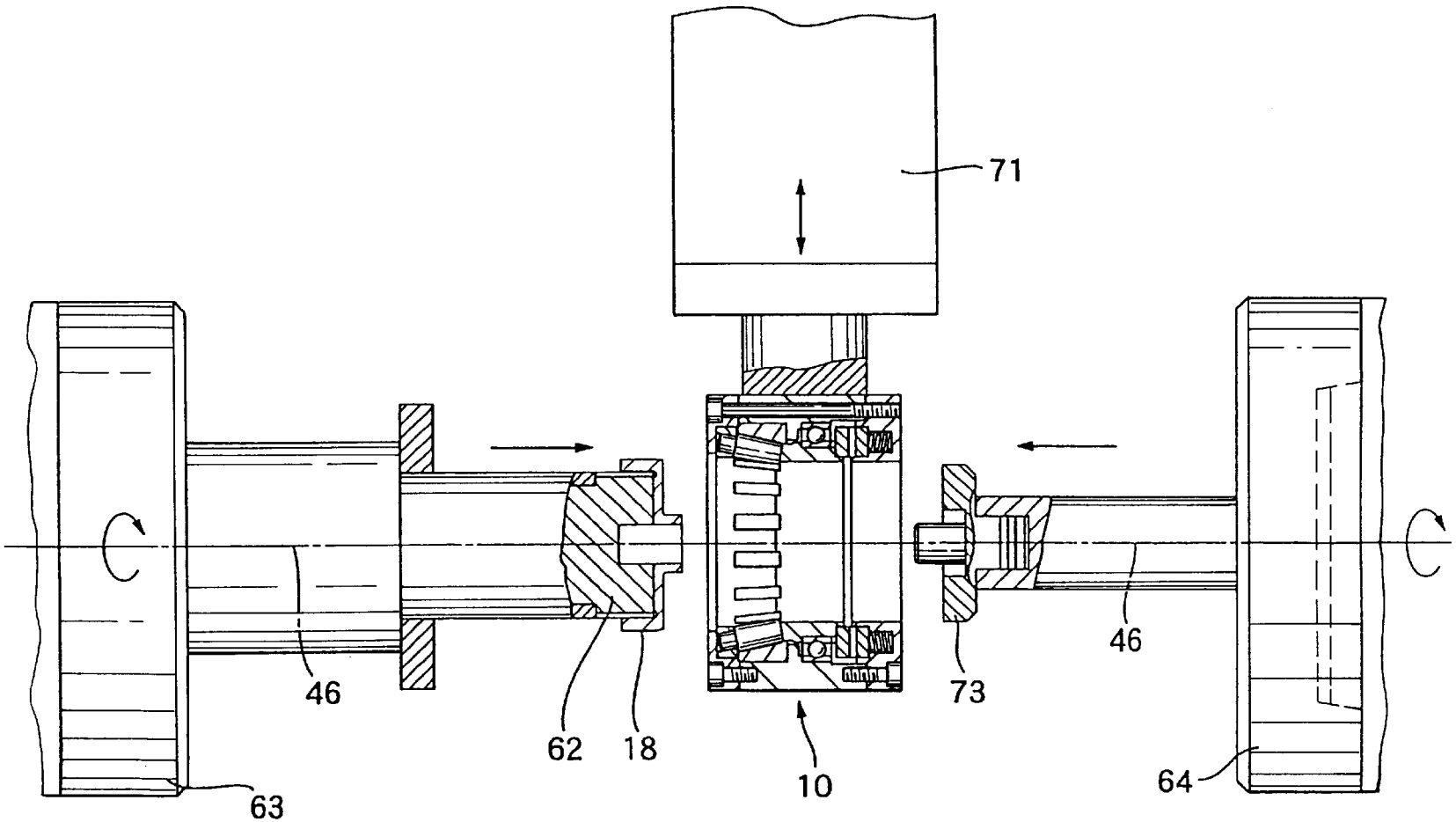
FIG. 10 is a variant of the structure and arrangement of the device or forming tool.

2. The forming device 10 is fixed to a radially infeedable feed mechanism 71 of a flow-forming machine (FIG. 10). For forming purposes, it moves the forming device 10 in the center of the flow-forming machine coaxially to the rotation axis 46 thereof. The tailstock spindle 64 moves through the forming device 10 and fixes the blank 18 to the spinning chuck 62. As a unit, the main spindle 63 and tailstock 64 rotate the spinning chuck 62, blank 18 and clamping plate 73 through the forming device 10. In this process the blank 18 is formed in the machined workpiece.

3. The tooth system is formed by a press operation (not shown). In central manner with respect to the forming device, a toothed, driven tool chuck, on which a blank is engaged, is fixed to a press bed. A forming device fixed to the ram of the press is then moved over the rotating blank and the internal tooth system is formed. Alternatively the forming device can be driven in the same way, so that the tool chuck is stationary. Through the use of following tools, it is possible in the same stage, to provide the blank with a tooth system.

Fundamentally, before or after the rolling in of an internal tooth system, it is possible to carry out a conventional flow-forming process, e.g. by shaping profiles or hubs. In addition, as described in DE 197 13 440 A1, an external tooth system can be produced. For this purpose, a draw ring with an internal tooth system is drawn over the workpiece. Then, the external tooth system produced in this way, can be sized with a synchro-unit according to DE 196 01 020 A1.

With the above-described method it is possible to reproducibly form in a very effective manner internal straight and helical tooth systems, which have high dimensional stability. The tooth systems produced by rolling in have a high degree of strain hardening, so that optionally with a suitable material choice and surface retreatment, a subsequent heat treatment can be avoided. A mechanical remachining of the surface is not generally necessary. It is possible to form or work workpieces, which could hitherto not be produced in non-cutting manner.

Thus, the method according to the invention can e.g. be performed in such a way that a) a blank can be engaged over an externally toothed tool and fixed,
b) use is made of a tool built up in conical manner from section rollers rotating about their own axes and revolving in planet-like manner about the center of the blank,
c) with a simultaneous rotary movement, the material of the blank is rolled in the tooth system of the tool chuck and an internal tooth system is formed,
d) with autocentering rollers a seating of the rollers is made superfluous, so that the rollers roll on a common outer race,
e) the outer race and tapered rollers of a standard tapered roller bearing can be used as components of the forming tool,
f) in a second operation a thus produced tooth system can be sized,
g) internal straight or helical toothed workpieces can be produced without cutting in a single setting,
h) through the combination with other forming processes, it is possible to produce external tooth systems, cylindrical steps and hubs in a single setting and
i) through the shaping or forming process the Material is hardened and bending stressing of the tool teeth is largely avoided.

Figure 13:
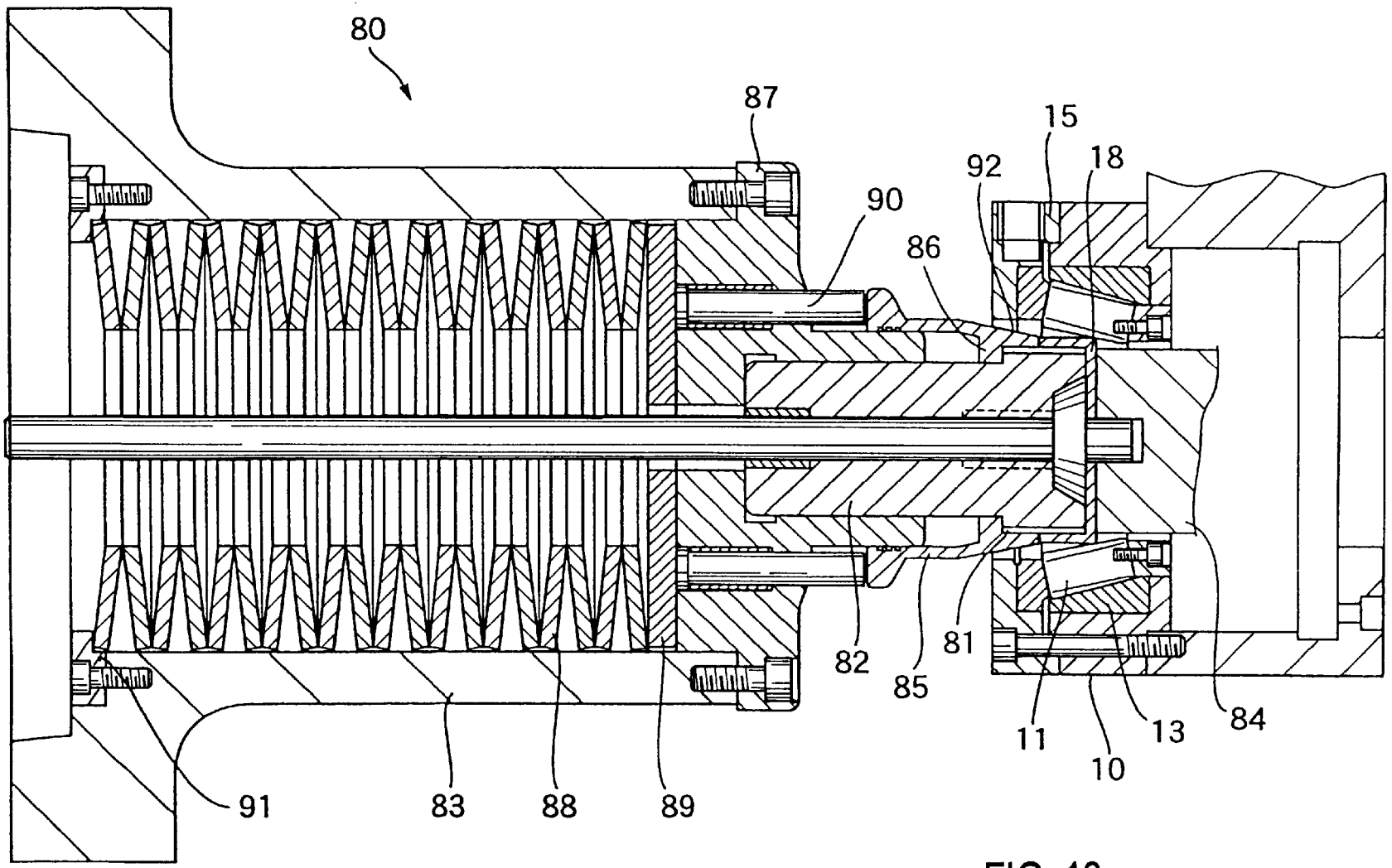
FIG. 13 is another device according to the invention in a sectional view.

FIG. 13 partly shows a flow-forming device 80 according to the invention. A cup-shaped blank 18 is fixed between a spinning chuck 82 with an external tooth system 81 and a tailstock 84. For shaping the blank 18 on the external tooth system 81, use is made of a forming device 10 with rolling members 11, which substantially corresponds to the above-described forming devices. The cage 13 for seating the rolling members 11 comprises axial and radial sliding surfaces without additional bearings in the casing 15.

The spinning chuck 82 is fitted in non-rotary manner to a cover 87, which is flanged to a substantially tubular main spindle connection 83. The main spindle connection 83 rotatable by a drive (not shown) has in its inner cavity, a clamping mechanism 88. The clamping mechanism 88, which is a spring washer set in the represented embodiment, can also be a hydraulic spring. The spring washer set is placed between an annular stop member 91 and a pressure plate 89 displaceable in the main spindle connection 83. To the pressure plate 89 are fixed several thrust bolts 90, which pass through the cover 87 through correspondingly shaped openings. The thrust bolts 90 are in contact with a front face of a sleeve-like back rest 85, which is mounted in axially displaceable manner on the spinning chuck 82. The end remote from the thrust bolt of the back rest 85 engages on a front face on the free end of the blank 18, in order to counteract any undesired lengthening of the preform or blank 18 on forming the internal tooth system.

The displacement path of the back rest 85 on the spinning chuck 82 is limited by a radially inwardly projecting step 86 on the back rest 85 and which engages in a correspondingly shaped groove on the spinning chuck 82.

The clamping mechanism 88, by means of the pressure plate 89 and thrust bolts 90, exerts on the back rest 85 an axial stressing force in the direction of the blank 18. As a result of the feed pressure in the case of very high feeds, a lengthening of the thin-walled blank 18 can be reduced or avoided, so that the material flows into the external teeth 81 of the spinning chuck 82 and not into the lengthening of blank 18. The tooth profile of the internal teeth to be shaped on the blank 18 can consequently be better filled. The displaceable and axially pretensioned back rest 85 ensures that with progressing tooth filling, the back rest can be moved back by excess residual material. This reduces the loading of the external teeth 81 on the spinning chuck 82 and consequently prevents premature tooth breakage. The magnitude of the force of the back rest 85 is a function of the resistance of the blank 18 to be formed. It is preferable for a uniform tooth filling, for the clamping mechanism 88 to exert a constant pressure, such as is e.g. easily attainable by a spring washer set or a hydraulic spring. In order to bring about a forming of the blank 18 to close to the back rest 85, the latter is provided at its end with a bevel 92, whose lead or taper angle is adapted to the angle of the conically positioned rolling members 11.

Figure 14:
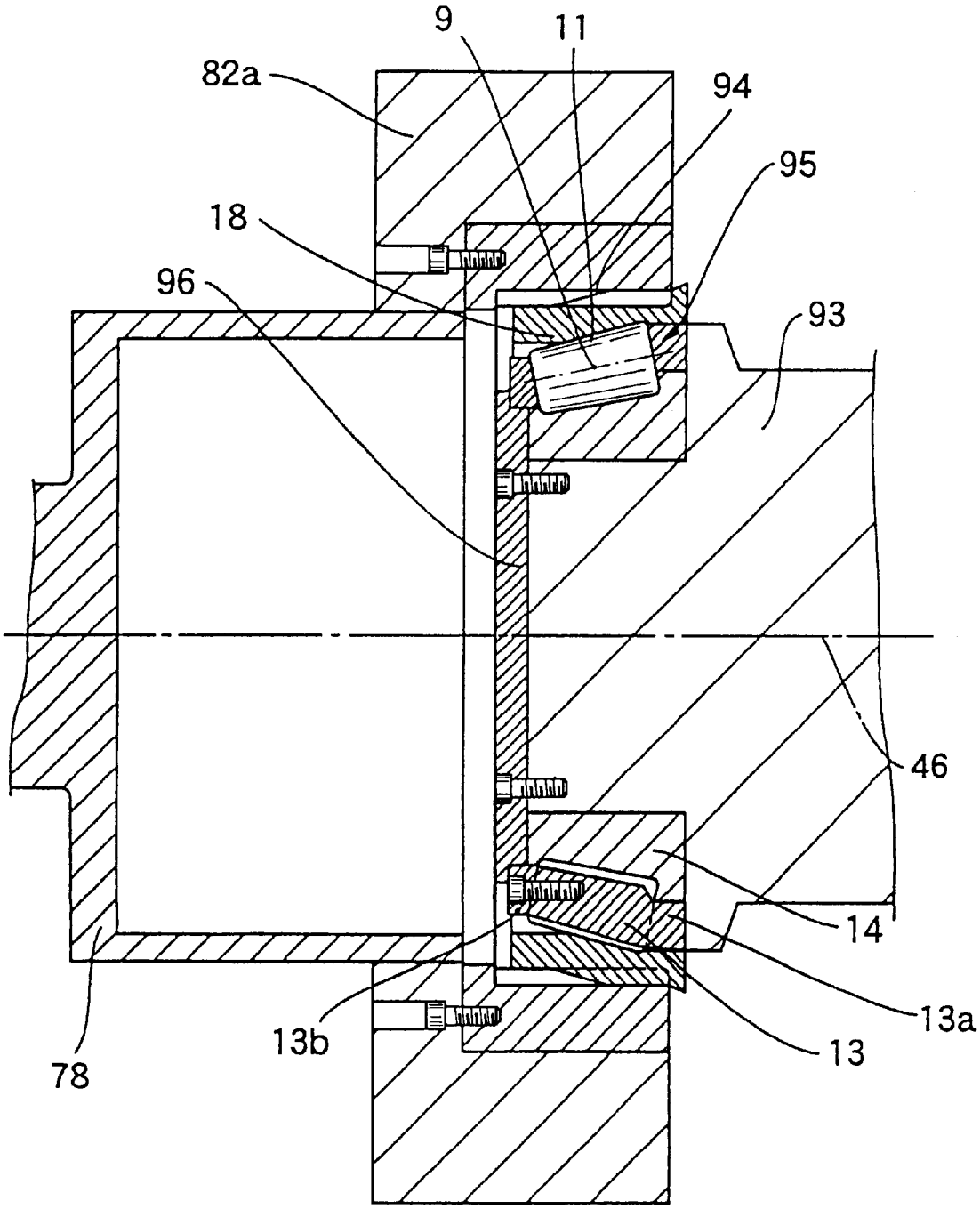
FIG. 14 is a flow-forming device for shaping an external profile in a sectional view.

FIG. 14 shows another inventive device, in which an annular spinning chuck 82*a* is provided with an internal tooth system 94. On the spinning chuck 82*a* is fixed as a workpiece a blank 18 having a central opening. By means of a drive (not shown) the spinning chuck 82*a* is rotatable about a rotation axis 46 relative to a spindle 93. Forming is brought about by an axial relative movement between the spinning chuck 82*a* and the spindle 93. An ejector 78 can be used for the axial clamping (not shown) corresponding to FIG. 13 and/or for ejecting the finished workpiece. The ejector 78 can be fixed or co-rotates.

For forming a forming mandrel, a forming device 95 is fitted to a spindle 93 by means of a gripping plate 96. The forming device 95 comprises a cage 13 and a radially internally located, conical ball race 14. The cage 13 comprises a ball race body 13*a* and a clamp collar 13*b*. The cage body 13*a* contains pocket-like recesses, in which are inserted conical rolling members 11 which are axially retained by the screwed-on clamping collar 13*b*. The pocket-like recesses taper radially outwards towards the workpiece. Each of the rolling members 11 has a rolling member axis 9, which is at an acute angle to the rotation axis 46. With this conical arrangement of a plurality of rolling members 11 on the forming mandrel, it is possible, through the axial displacement of the forming mandrel into the central opening of the blank 18, to press the latter radially outwards against the internal teeth 94 on the spinning chuck 82*a*. Thus, a corresponding external tooth system is formed on the workpiece.

Figure 15:
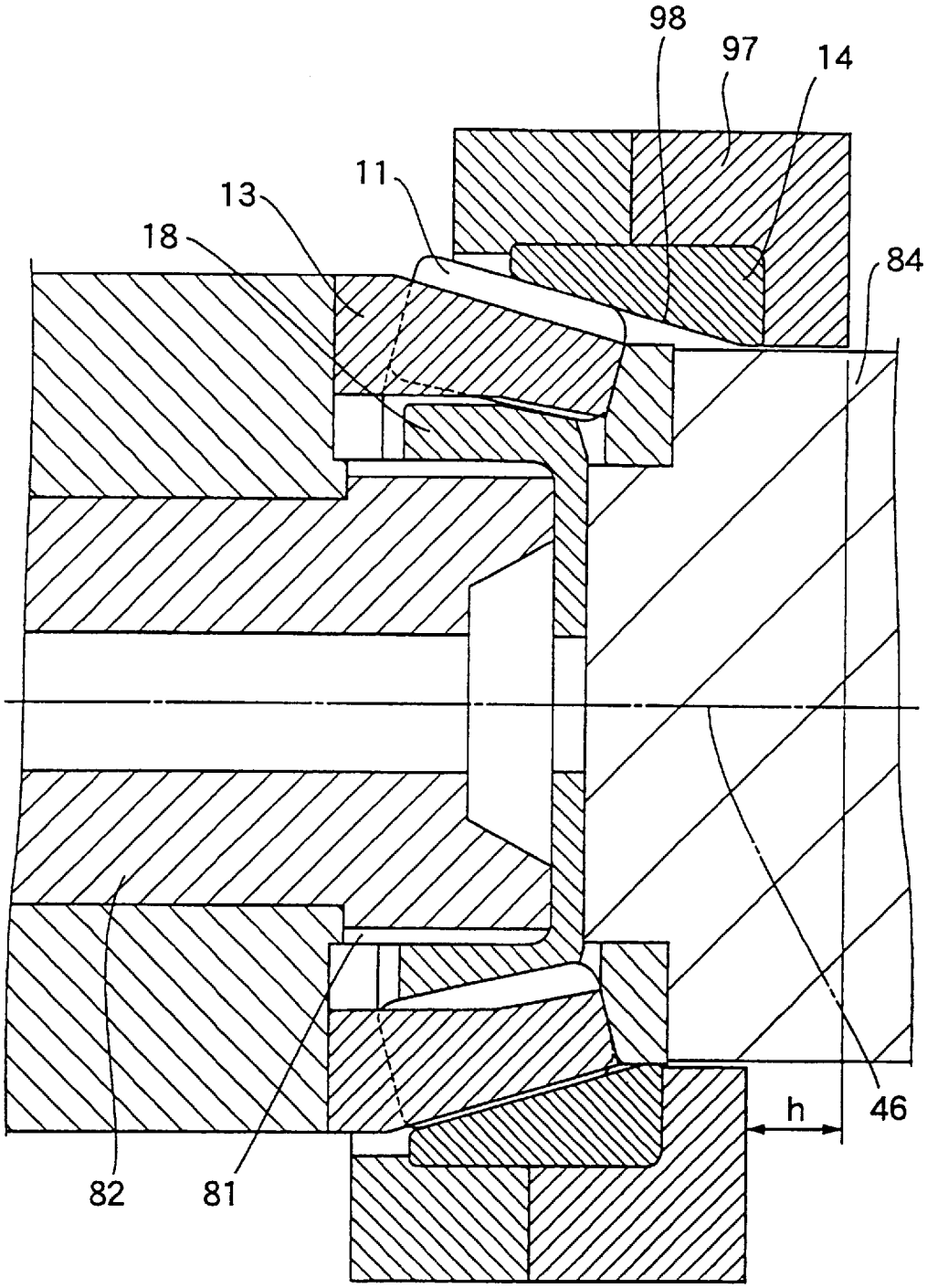
FIG. 15 is a flow-forming device with radial adjustment of the rolling members in a sectional view.

Another device according to the invention is shown in FIG. 15, in which the upper half shows a state at the start of forming and the lower half a state towards the end of forming.

On a spinning chuck 82 with an external tooth system 81 is fixed a cup-shaped blank 18 and is rotated about the rotation axis 46. The blank 18 is clamped by axial infeeding the tailstock 84, to which is fitted a forming device with an annular cage 13 and rolling members 11 mounted therein. The rolling members 11 are rotatable in the cage 13 and are displaceable in a radial direction to the rotation axis 46, being mounted and axially fixed in recesses. A ball race 14 with a conical rolling surface 89 is fitted in a non-rotary control element 97, which is axially displaceable to the tailstock 84. After the clamping of the blank 18, the control element 97 is moved by a hydraulic piston by a stroke h in the direction of the spinning chuck 82. As a result of the conical rolling area 98 in conjunction with the conical arrangement of the rolling members 11, a wedge valve mechanism is obtained, through which the rolling members 11 can be moved radially inwards and the cylindrical wall of the blank 18 can be pressed into the external teeth 81. Here again, as a function of the desired operating made, the control element 97 can be fixed and the spinning chuck 82, with tailstock 84 and blank 18 can be rotated about the rotation axis 46 or the control element 97 can be rotated about the rotation axis 46 and the spinning chuck 82, with tailstock 84 and blank 18 can be fixed. In both cases, the cage 13 rotates relative to the control element 97 and spinning chuck 82, so that the rolling members 11 circle in planet-like manner the rotation axis 46.

Figure 16:
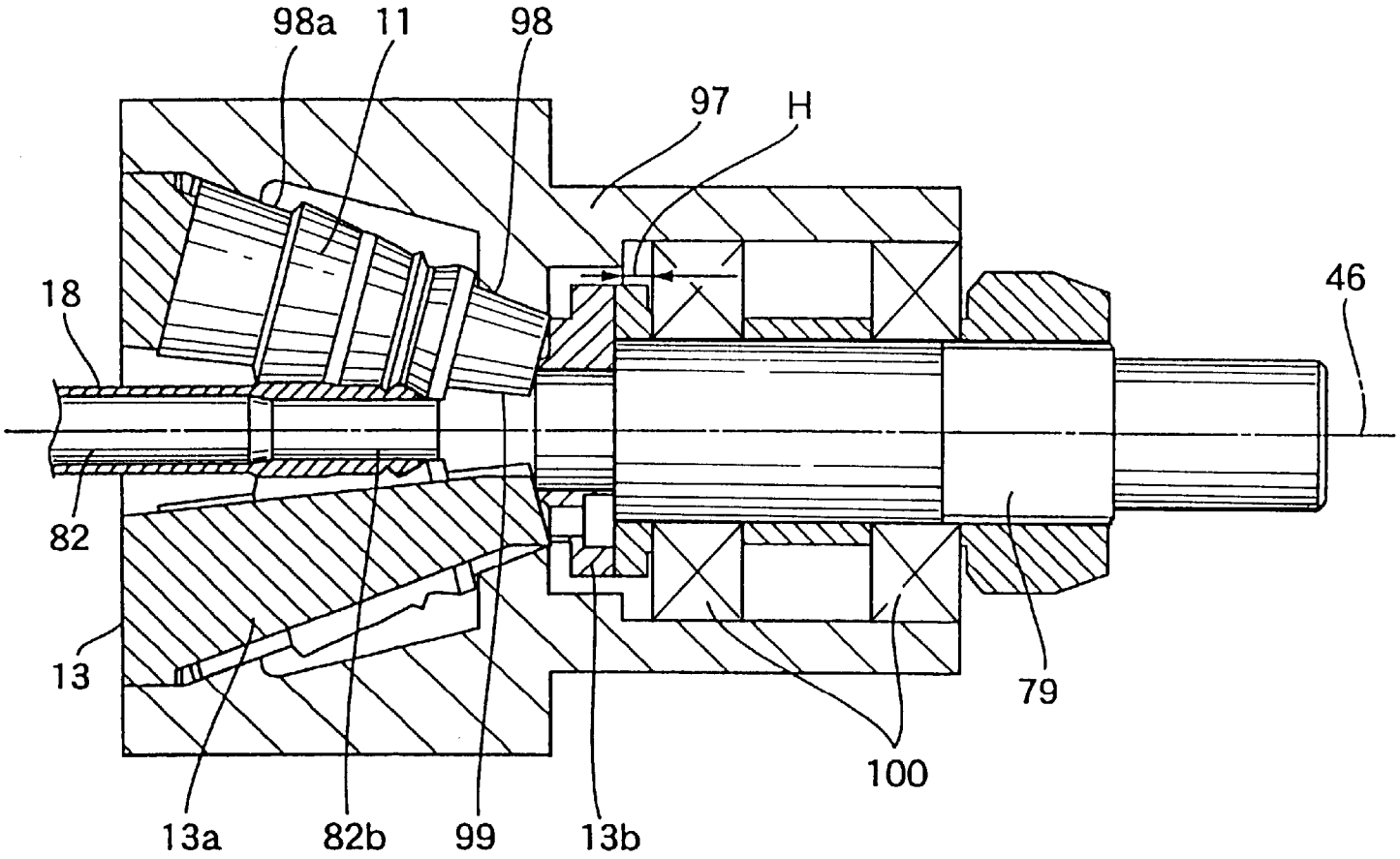
FIG. 16 is a flow-forming device for forming an external profile by radially adjustable rolling members in a sectional view.

Another embodiment of the principle shown in FIG. 15 can be seen in FIG. 16. Two rolling members 11 are mounted in a rotary and radially displaceable manner in a cage 13 and have an external profile with circumferentially directed grooves and projections. In simple manner the rolling members 11 are inserted in pocket-like recesses on a cage body 13*a* and are held in rotary and displaceable manner in said recesses and are axially positionally fixed by a clamp collar 13*b*.

In addition, a control element 97 is provided which, apart from a displacement movement in the axial direction, also takes over the function of the ball race. For this purpose, a conical rolling area 98 is provided on which the rolling members 11 roll.

The fixed, axially displaceable blank 18 is engaged on a shaping area 82*b* of the spinning chuck 82 on a fixed mandrel 97, which is also axially fixed. The driven control element 97, which is rotatably and axially mounted by means of bearings 100, as a result of the axial displacement movement, in the vicinity of the conical bearing surfaces 98, has contact with the conical bearing surfaces 98*a* of the rolling members 11.

The rolling members 11 are mounted in accordance with the above-described principle as follows:

tangentially: by the cage 13 with the radial grooves, in which a smaller opening is on the inside;

radially: by the conical bearing surfaces 98*a,* outwardly limited by contact with the bearing surfaces 98 of the control element 97, while towards the inside, a limitation 99 can be brought about by the mandrel 79 for fixing the desired finished diameter of the profile on the blank 18;

axially: by the cage 13 with clamp collar 13*b*.

FIG. 16 shows the situation of the embodiment after forming has taken place, i.e. the rolling members 11 have contact with the boundary 99 of the mandrel 79 and the axial stroke H of the control element 97 is extended. For loading the forming tool the control element 97 is moved back, the rolling members 11 having no contact with the boundary 99 and are spaced therefrom.

The finished workplace is released by the rolling members 11. In this position of the rolling members 11 the blank, which is in the form of a pipe, can be replaced. The preform 18 is clamped in position by the clamping mechanism on the spinning chuck 82. As soon as the driven, rotary control element 97 has contact in the vicinity of the conical bearing surfaces with the axially fixed rolling members 11 in the cage 13, rolling members 11 roll on the conical bearing surfaces 98. The cage 13 rotates about the rotation axis 46, so that the rolling members 11 circle in a planet-like manner while the blank is located on the pin 18*a* in the centre of the rotation axis 46. The cage 13 also rotates about the rotation axis 46. With increasing axial stroke H of the control element 97, the rolling members 11 are moved radially towards the blank 18 due to the conicity of the bearing surface 98 in the control element 97. The rolling members 11 are axially held in position by the cage 13.

For large workpieces, as a function of the desired operating mode, it is possible to radially fix the control element 97 and to rotate the mandrel 84 with blank 18. The clamping mechanism on the spinning chuck 82 then becomes a live or moving tailstock.

The device shown in FIG. 16 is in a 1:1 scale. This makes it clear that the invention permits a particularly simple and therefore also very compact arrangement for the flow-forming of even small parts. In this embodiment, the blank 18 is a pipe section or length, on whose free end is shaped a connector.

Figure 17:
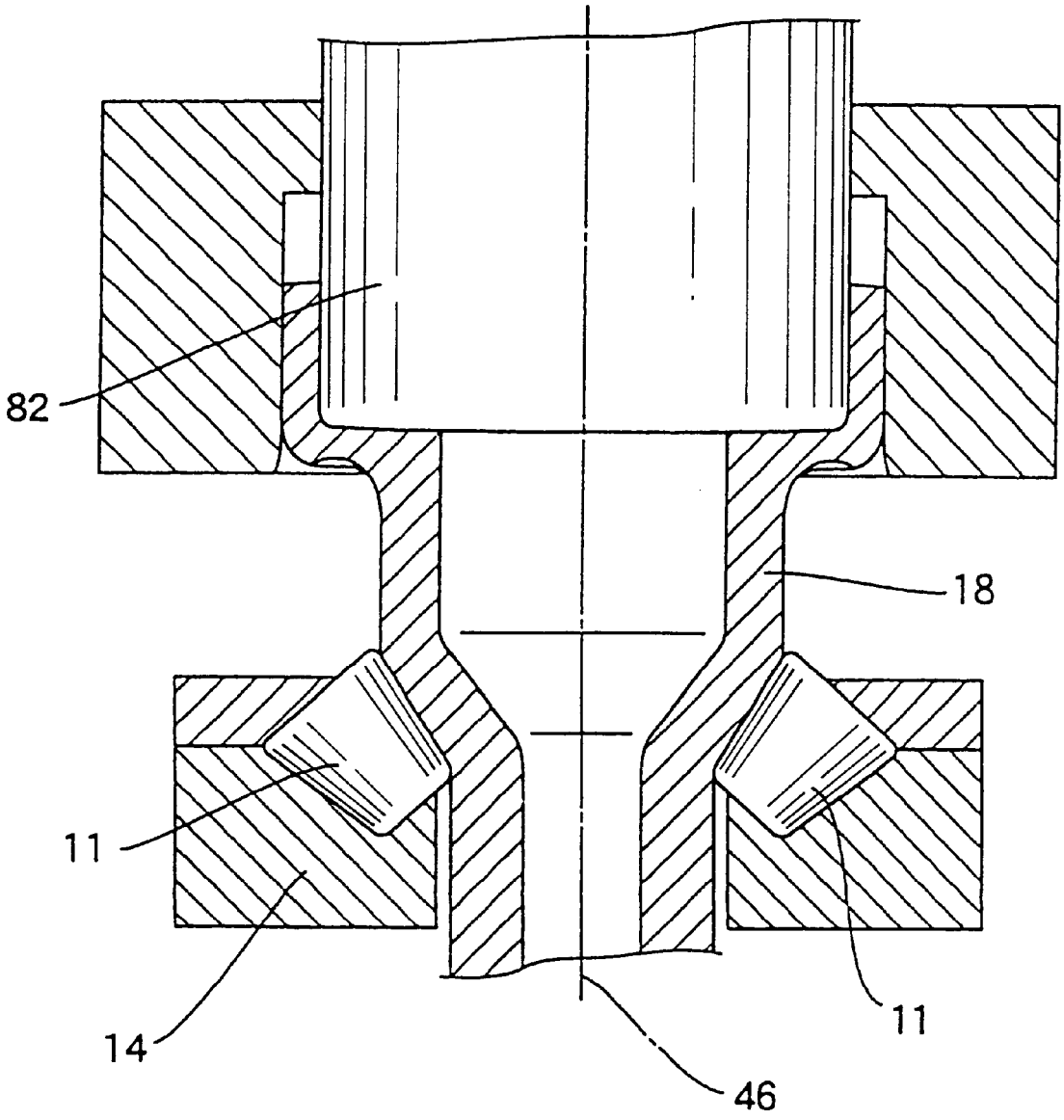
FIG. 17 is a device for performing the inventive method, particularly for reducing the external diameter of a blank in a sectional view.

In the case of the flow-forming device shown in part sectional form in FIG. 17, an external diameter reduction takes place for a blank 18 fixed to a spinning chuck 82.

This takes place through the engagement of a hollow roller with the blank 18, said hollow roller comprising a ball race 14 and several rolling members 11 located therein.

The relative rotation of the hollow roller against the blank 18 about rotation axis 48 necessary for forming purposes is attained in the case of a fixed blank 18 through the rotary drive of the hollow roller. However, in principle, a rotary drive of the blank 18 is also possible.

The rolling members 11 are mounted in rotary manner in cages, which are not shown in detail in FIG. 17 so as not to overburden the representation. The same applies for the different rolling members of the embodiments shown in FIGS. 18 to 21.

Figure 18:
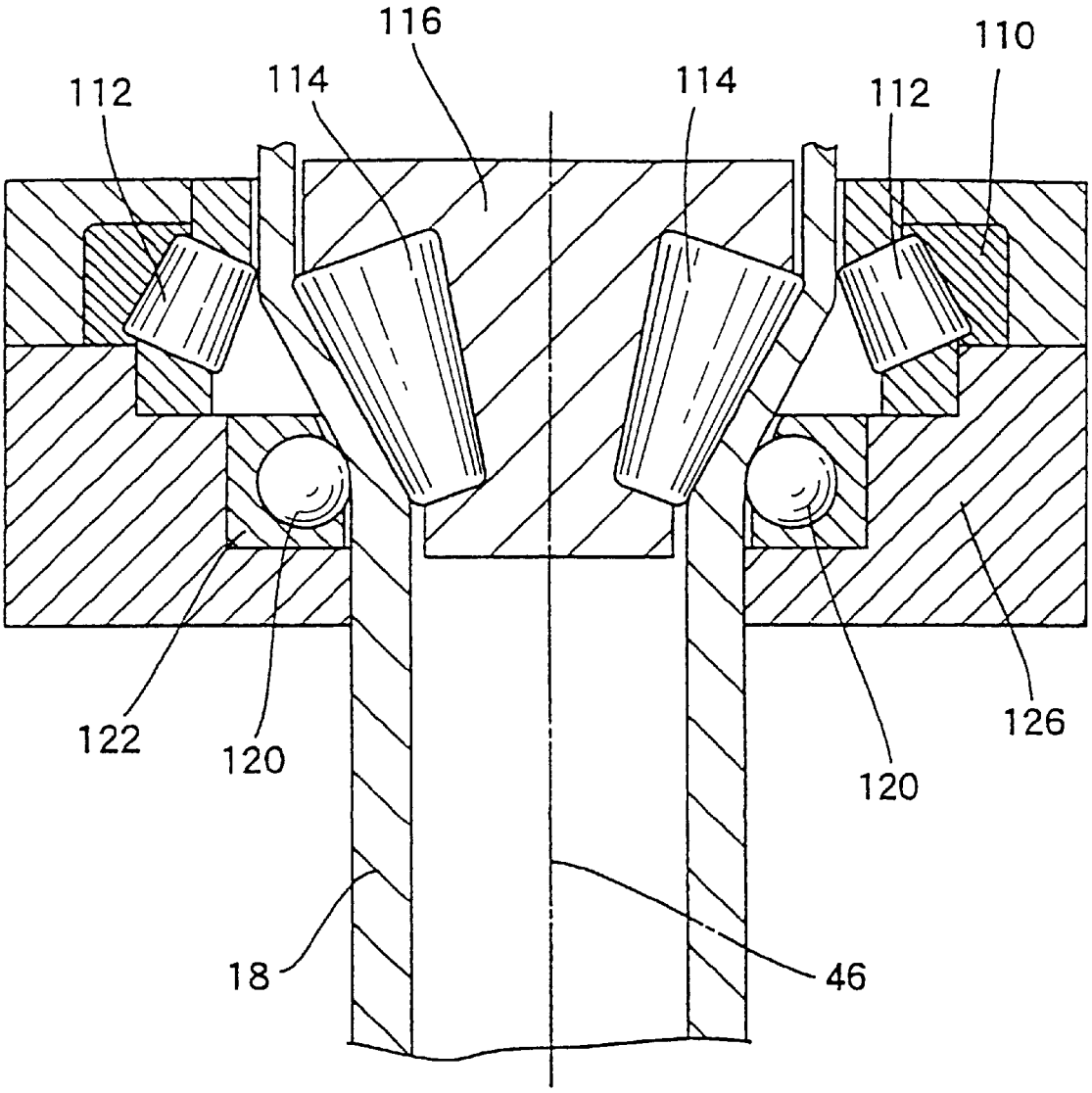
FIG. 18 is another device for performing the inventive method, particularly for expanding a hollow shaft in a sectional view.

FIG. 18 is a sectional view of part of a flow-forming device, which is used for expanding and sizing a hollow shaft to a precisely defined external diameter. In the case of the flow-forming device shown, a plurality of conical rolling members 114 are located on a forming mandrel 116. The forming mandrel 116 is axially infed (relative to the rotation axis 46) into a central opening of the blank 18, the conical rolling members 114 contacting the inside of the blank 18. Additionally, the flow-forming device shown in FIG. 18 has several conical rolling members 112 mounted in a first outer race 110, as well as cylindrical rolling members 120 mounted in a second outer race 122. The first and second outer races 110, 122 are connected by a holding ring 126. The forming mandrel 116 with the conical rolling members 114 mounted therein can also be referred to as a front or inner roller. The further, conical rolling members 112 and the cylindrical rolling members 120 contact the outside of the blank 18, so that overall, said rolling members can be referred to as an outer roller. Also in the case of this flow-forming device, the blank 10 can be fixed and the inner and outer rollers driven in rotary member. The possibility also exists of driving the inner and outer rollers in a feed and speed separated manner. It is also possible to rotate the blank 18. A special feature of the flow-forming device of FIG. 18 is that the first and second outer races 110, 122 are firmly interconnected by the holding ring 126 and are consequently only jointly axially infed (relative to the rotation axis 46) and can be driven at the same speed.

Figure 19:
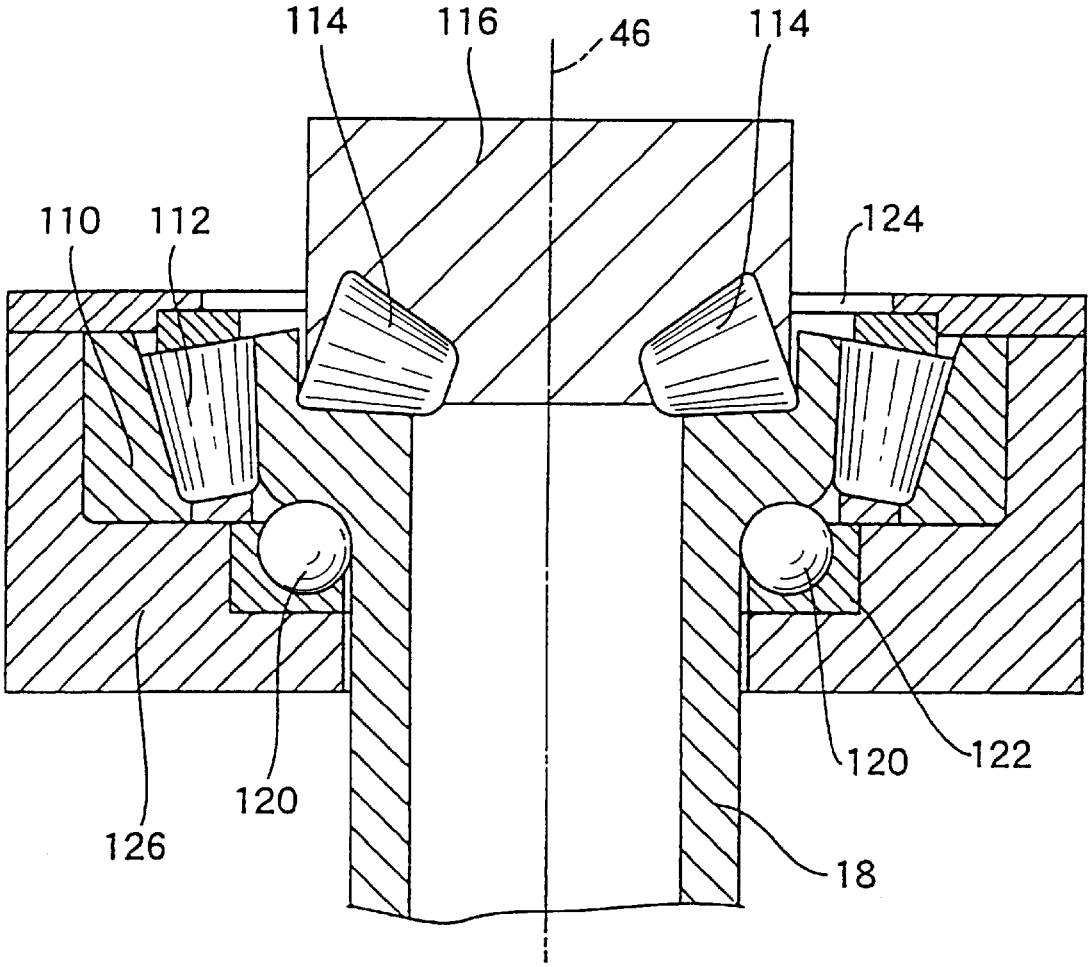
FIG. 19 is another device for performing the inventive method, particularly for reducing a flange thickness and for shaping a cylindrical shoulder in a sectional view.
Figure 20:
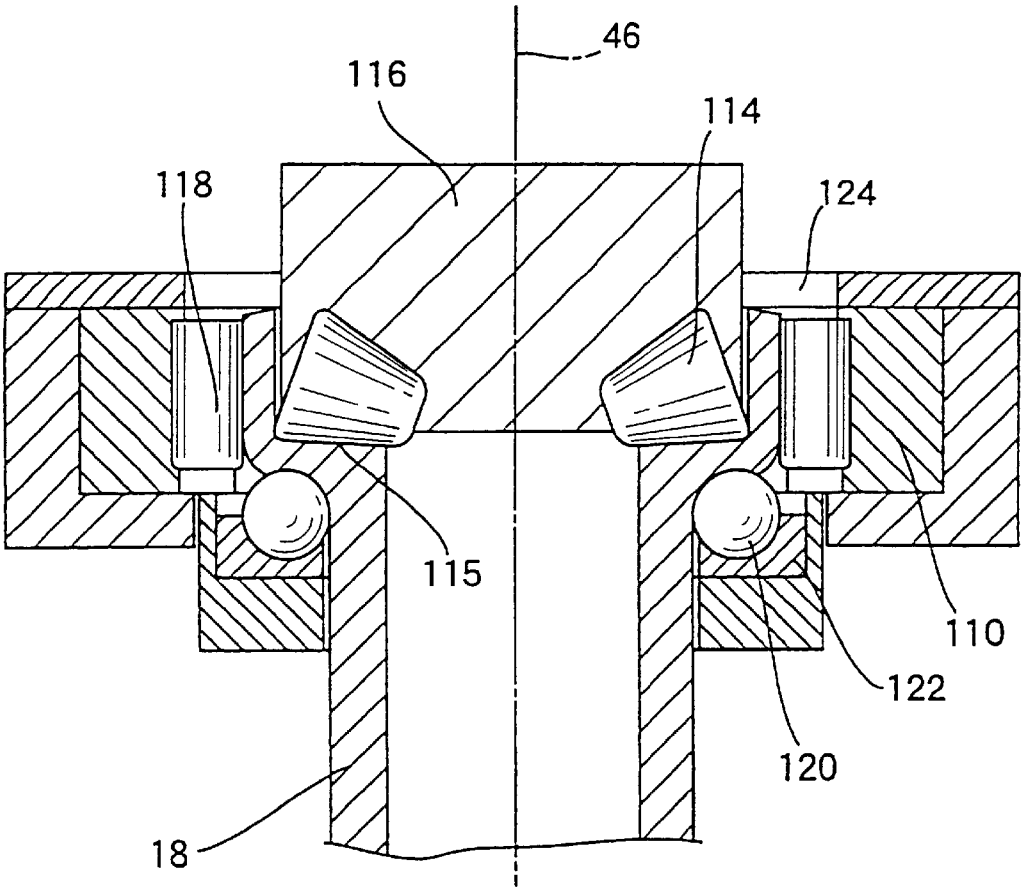
FIG. 20 is another device for performing the inventive method, particularly for sizing a Plane surface and the external diameter of a hollow shaft in a sectional view.
Figure 21:
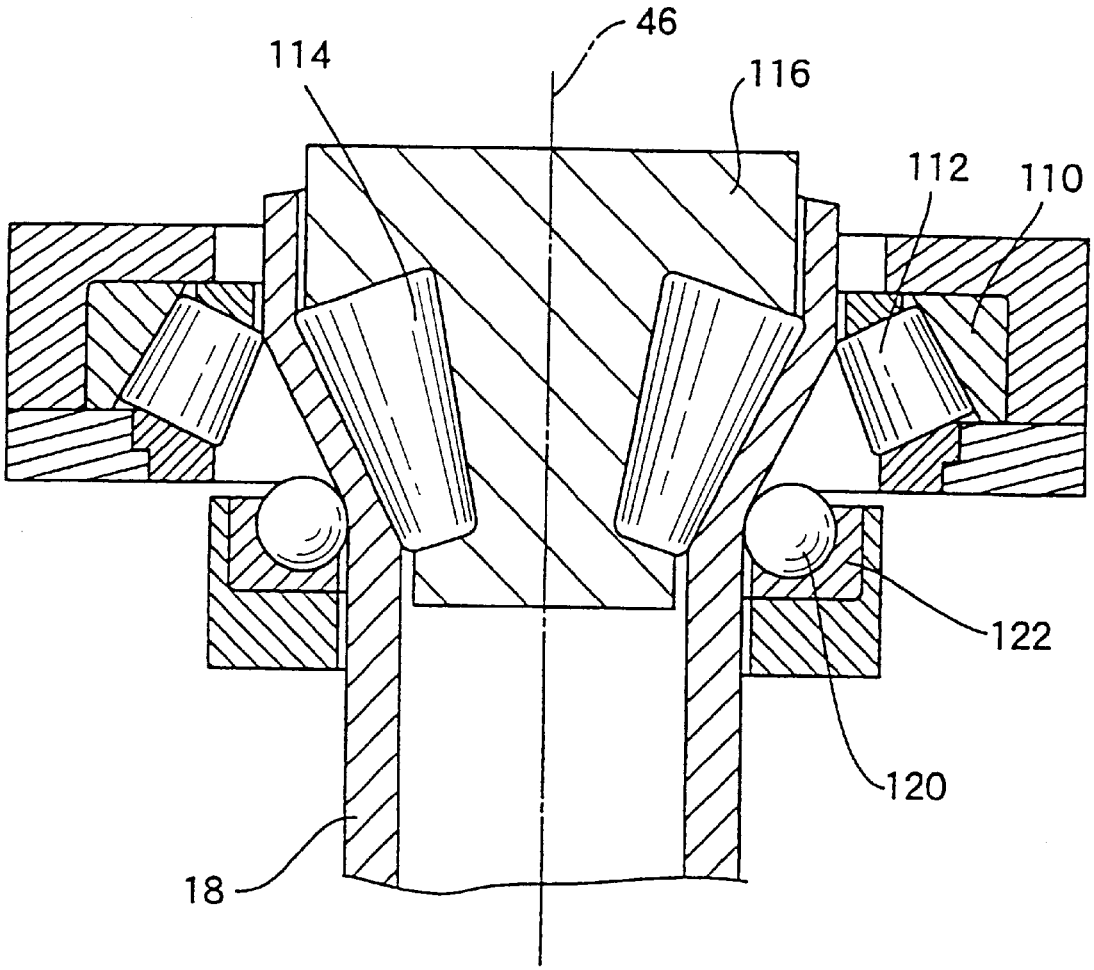
FIG. 21 is another device for performing the inventive method, particularly for expanding a hollow shaft in a sectional view.

Flow-forming devices, similar to the apparatus shown in FIG. 18, are shown in FIGS. 19 to 21. Corresponding components are in each case given the same reference numerals.

The flow-forming device of FIG. 19 is constructed in a special way for reducing a flange thickness of the blank 18, accompanied by the simultaneous shaping of a cylindrical shoulder on the blank 18. The flow of material in the axial direction (relative to the rotation axis 46) is limited by an end collar 124. For shaping the cylindrical shoulder on the blank 18, the conical rolling members 114 of the forming mandrel 116 are so positioned that the contact surface 115 between the conical rolling member 114 and the blank 18 is perpendicular to the rotation axis 46.

An arrangement very similar to the flow-forming device of FIG. 19 is shown in part sectional form in FIG. 20. The essential difference compared with the flow-forming device of FIG. 19 is that the first outer race 110 contains cylindrical instead of conical rolling members 118.

Finally, the arrangement shown in part sectional form in FIG. 21 is similar to the flow-forming device of FIG. 18. However, in the flow-forming device of FIG. 21 the first and second outer races 10, 122 are mechanically separated, so that a separate, axial infeed (based on the rotation axis 46) and a different speed of the two outer races is possible.

Figure 22:
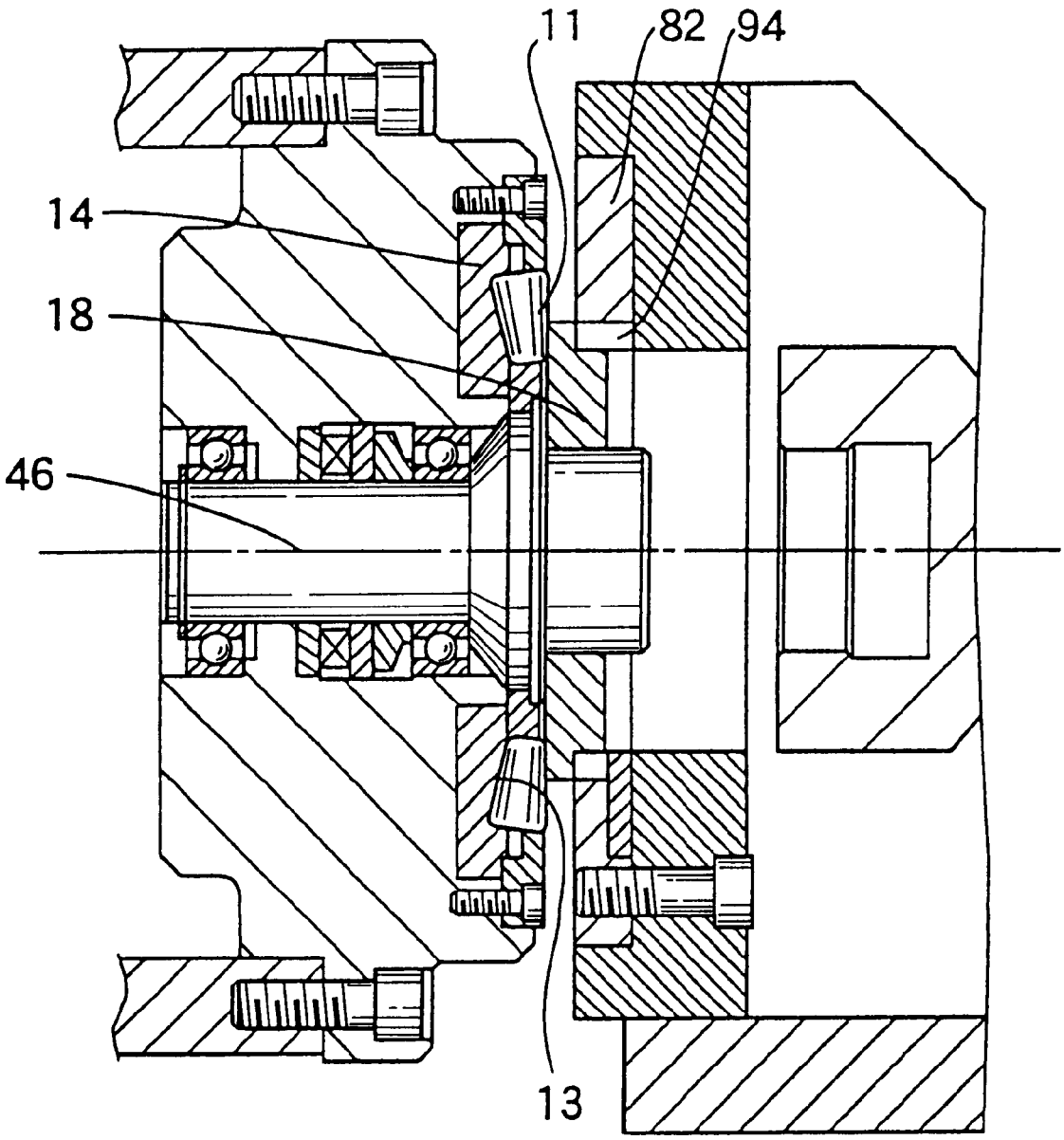
FIG. 22 is another device for performing the inventive method, particularly for shaping external teeth in a sectional view.

A further variant of a flow-forming device is shown in part sectional form in FIG. 22. In a blank 18 is machined an external profile, in that the blank 18 is pressed by rolling members 11 mounted in rotary manner in a cage 13, into a spinning chuck 82, which is provided with an internal contouring 94.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for flow-forming, in which a blank is fixed on a spinning chuck and formed by means of at least one rolling member, comprising the steps of:

rotating at least one of the blank and the rolling member about a rotation axis; and flow-forming the blank through contact with a plurality of rolling members which are arranged in ring-like manner around the rotation axis and mounted in rotary manner in a cage, wherein the step of flow-forming comprises contacting the blank with conical rolling members which roll in an inclined manner in a conical ball race with respect to the rotation axis of the blank, and wherein the step of flow-forming further comprises pressing the blank against the rolling members with a cylindrical spinning chuck which has an external tooth system.

2. The method according to claim 1, wherein during said step of flow-forming, the blank is moved in a relative axial movement with respect to the rolling members arranged in ring-like manner.

3. The method according to claim 1, wherein said step of flow-forming comprises contacting the blank with mutually axially displaced rolling members.

4. The method according to claim 1, wherein said step of flow-forming comprises contacting the blank with the rolling members, which are distributed in two parallel planes perpendicular to the rotation axis in a forming device.

5. The method according to claim 4, wherein said step of flow-forming comprises contacting the blank with rolling members with different shapes.

6. The method according to claim 5, wherein said step of flow-forming comprises:

a first forming step of contacting the blank with spherical rolling members in a first machining area; and a second forming step of contacting the blank with conical rolling members in a second machining plane after said first forming step.

7. The method according to claim 1, further comprising:

setting a radial positioning of the rolling members against a spring tension.

8. The method according to claim 1, further comprising alternating the relative rotation direction between the blank or spinning chuck and the rolling members.

9. The method according to claim 1, wherein said step of rotating comprises the steps of:

(a) rotating an outer race, in which the rolling members roll while holding the blank stationary;

(b) rotating the blank with the outer race stationary; or (c) rotating the outer race and the blank.

10. The method according to claim 1, wherein said step of flow-forming comprises pressing a blank constituted by an axially symmetrical sheet metal workpiece, onto the spinning chuck by the rolling members arranged in ring-like manner.

11. The method according to claim 1, wherein said step of flow-forming comprises pressing the blank against the rolling members with a cylindrical spinning chuck to which the blank is fixed, and whose outer circumference is provided with a contouring, wherein during forming, the rolling members are arranged in ring-like manner around the spinning chuck.

12. The method according to claim 1, wherein said step of flow-forming comprises:

(a) pressing the blank which has a central opening and which is fixed on an annular spinning chuck which has an inner ring provided with a contouring; and (b) infeeding a forming mandrel into the central opening of the blank, wherein the forming mandrel includes a ring-like arrangement of the rolling members, so as to press the blank against the inner ring and thereby form an external profile on the blank.

13. The method according to claim 12, wherein said step of pressing the blank which has a central opening and which is fixed on an annular spinning chuck which has an inner ring provided with an internal tooth system.

14. The method according to claim 1, wherein said step of flow-forming further comprises at least radially displacing the rolling members in the cage.

15. The method according to claim 1, further comprising the step of drawing a draw ring with an internal tooth profile so as to form an external tooth system on the blank.

16. The method according to claim 1, further comprising contacting the rolling members to the outside of the blank and thereby reducing the external diameter of the blank.

17. The method according to claim 1, wherein said step of flow-forming comprises infeeding a forming mandrel into a central opening of the blank, wherein the forming mandrel includes a ring-like arrangement of the rolling members, so as to contact the inside of the blank.

18. The method according to claim 17, wherein said step of flow-forming comprises reducing a wall thickness of the blank by contacting the outer surface of the blank with rolling members distributed in a first outer race in a first plane and rolling members distributed in a second outer race in a second plane, the first and planes being perpendicular to the rotation axis.

19. The method according to claim 1, wherein the blank is axially formed.

20. A flow-forming device comprising:

a forming device including a cage in which a plurality of rolling members are rotatably arranged in ring-like manner about a rotation axis;

a spinning chuck configured to hold a blank, said spinning chuck being axially displaceable relative to said forming device; and a drive for rotating the blank relative to said forming device, wherein said forming device has a conical ball race on which the rolling members engage, wherein at least one rolling member of said plurality of rolling members is conical and is configured to roll in said conical ball race in an inclined manner, and wherein said spinning chuck is cylindrical and has an external tooth system.

21. The flow-forming device according to claim 20, wherein the rolling members are constructed as forming rolls with at least one of a cylindrical shape and a conical shape, and are mounted so as to rotate about a rolling member axis which is inclined to the rotation axis by an angle between 1° and 60°.

22. The flow-forming device according to claim 20, wherein said ball race has a rolling area on which the rolling members engage and roll during forming.

23. The flow-forming device according to claim 22, wherein said rolling area of said ball race is conical, wherein the rolling members are configured to be radially displaceable cage and wherein said ball race is axially adjustable for radial displacement of the rollers members.

24. The flow-forming device according to claim 20, wherein said forming device is annular and wherein the rolling members project on an inside of the forming device.

25. The flow-forming device according to claim 20, wherein said forming device is constructed as a cylindrical or conical forming mandrel on whose outside project the rolling members.

26. The flow-forming device according to claim 20, wherein said spinning chuck is at least one of cylindrical and annular.

27. The flow-forming device according to claim 20, wherein for rotary mounting purposes, the rolling members are received in pocket-like recesses in said cage.

28. The flow-forming device according to claim 20, wherein the rolling members have an external profile.

29. The flow-forming device according to claim 20, wherein said spinning chuck includes a back rest for contacting a front face of the blank, wherein said back rest is pretensioned towards the blank.

30. The flow-forming device according to claim 20, wherein the rolling members of said forming device are arranged at an angle to the rotation axis in such a way that the contact areas between the blank and the rolling members are perpendicular to the rotation axis.

* * * * *